US008393925B2

(12) United States Patent
Harada et al.

(10) Patent No.: US 8,393,925 B2
(45) **Date of Patent: *Mar. 12, 2013**

(54) STEERING DEVICE FOR OUTBOARD ENGINE

(75) Inventors: Yoshihiro Harada, Wako (JP); Yoshihiro Takahashi, Wako (JP); Koichi Oka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 217 days.

This patent is subject to a terminal disclaimer.

(21) Appl. No.: 12/947,166

(22) Filed: Nov. 16, 2010

(65) Prior Publication Data

US 2011/0117798 A1 May 19, 2011

(30) Foreign Application Priority Data

Nov. 19, 2009 (JP) ..... 2009-263885
Nov. 30, 2009 (JP) ..... 2009-272099

(51) Int. Cl.
*B63H 20/08* (2006.01)

(52) U.S. Cl. ..... 440/58

(58) Field of Classification Search ..... 440/53, 440/58, 61 R, 62, 63
See application file for complete search history.

(56) References Cited

U.S. PATENT DOCUMENTS

| | | | | |
|---|---|---|---|---|
| 2,951,460 | A * | 9/1960 | Pierson | 114/144 R |
| 3,796,178 | A * | 3/1974 | Smith | 114/144 R |
| 5,244,426 | A * | 9/1993 | Miyashita et al. | 440/60 |
| 6,715,438 | B1 * | 4/2004 | Hundertmark | 114/144 R |
| 7,097,520 | B2 * | 8/2006 | Okumura et al. | 440/1 |

FOREIGN PATENT DOCUMENTS

JP 2005-231383 9/2005

* cited by examiner

*Primary Examiner* — Daniel Venne
*Assistant Examiner* — Anthony Wiest
(74) *Attorney, Agent, or Firm* — Rankin, Hill & Clark LLP

(57) ABSTRACT

In a steering device for an outboard engine, a drive shaft of a helm mechanism and an output shaft of an electric assist mechanism are disposed orthogonally to a steering output shaft of a steering operation member. Where the steering operation member is a tiller handle, a torque sensor, provided between an outboard engine body and the tiller handle, detects, as steering torque, a difference between steering angles of the engine body and the tiller handle, and the helm mechanism, drivable by the assist mechanism, operates to compensate for the difference between the steering angles. The assist mechanism and the helm mechanism are provided on the body of the boat.

3 Claims, 17 Drawing Sheets

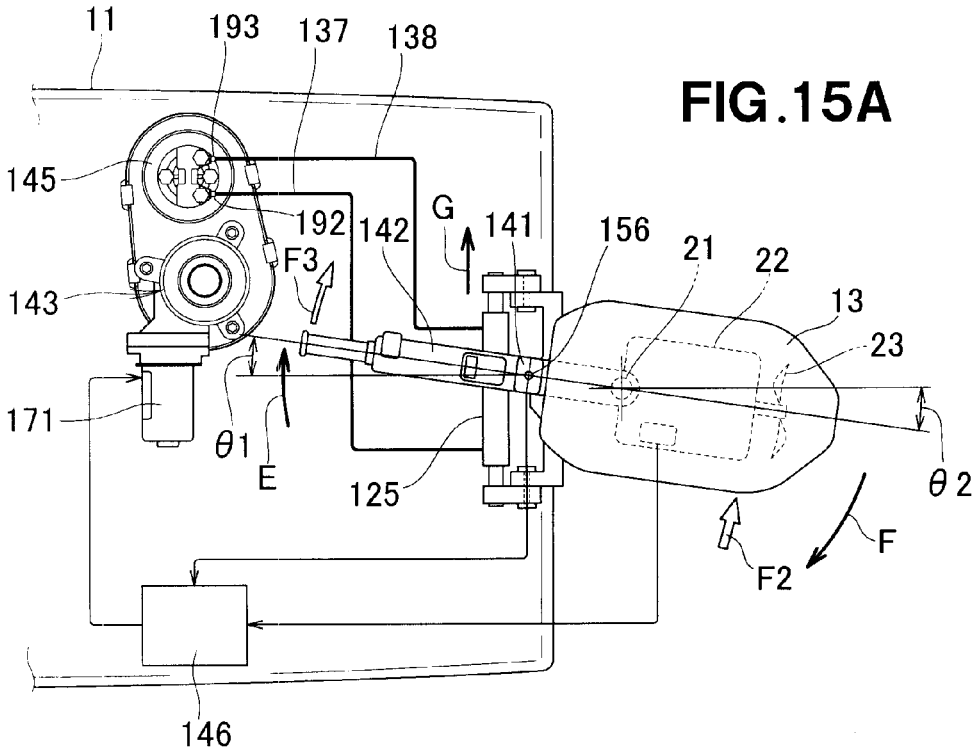
FIG.15A
FIG.15B
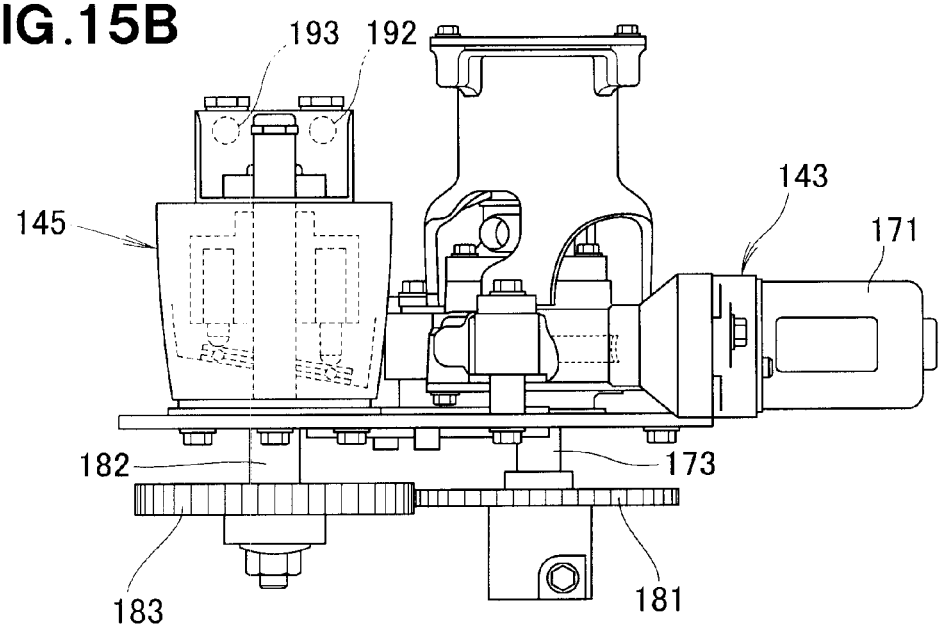

STEERING DEVICE FOR OUTBOARD ENGINE

FIELD OF THE INVENTION

The present invention relates to a steering device for an outboard engine which operates a helm mechanism (steering mechanism) in response to operation of a steering operation member, provided on the body of a boat, so as to steer the outboard engine via the helm mechanism.

The present invention also relates to a steering device for an outboard engine that is mounted to the body of a boat and steerable via a tiller handle connected to the body of the outboard engine.

BACKGROUND OF THE INVENTION

Generally, in boats provided with an outboard engine, a steering wheel or tiller handle is used, as s steering operation member of a steering device, for steering the outboard engine mounted on a rear end portion of the body of the boat. Among the conventionally-known outboard engine steering devices is one which includes an assist mechanism provided between a steering wheel and a hydraulic helm pump (hydraulic steering pump), and in which steering force (operating force) of the steering wheel is assisted by the assist mechanism. One example of such a steering device is disclosed in Japanese Patent Application Laid-Open Publication No. 2005-231383 (hereinafter referred to as "the patent literature"). Because the steering wheel is provided on a front portion of the body (typically on an instrument panel) of the boat separately and at a considerable distance from the outboard engine, the assist mechanism and hydraulic helm pump can be provided near the steering wheel.

With the prior art steering device disclosed in the patent literature, as the steering wheel is operated, the steering force of the steering wheel is assisted by the assist mechanism, so that a drive shaft of the helm mechanism can be actuated with a relatively small steering force; namely, the necessary steering force of the steering wheel can be reduced by the provision of the assist mechanism. By the drive shaft of the helm mechanism being operated as above, oil is ejected from the helm mechanism and directed to a steering means, so that the steering means is actuated by the oil to steer the outboard engine.

However, the prior art steering device disclosed in the patent literature, where the helm mechanism is provided in axial alignment with the steering wheel and assist mechanism, would undesirably have a great total length from the steering wheel to the helm mechanism. Thus, a relatively great installation space would be required on and in the body of the boat for installing the prior art steering device. Therefore, the application of the prior art steering device disclosed in the patent literature is limited only to boats where a relatively great installation space can be secured on and in the body of the boat.

Also known are steering devices provided with a tiller handle, in which the tiller handle is connected, via a connection section, to the body of the outboard engine so that the outboard engine body can be steered by a human operator operating the tiller handle leftward or rightward. However, because the tiller handle is connected to the outboard engine body via the connecting section, it is difficult to provide the assist mechanism and helm mechanism near the tiller handle.

SUMMARY OF THE INVENTION

In view of the foregoing prior art problems, it is an object of the present invention to provide an improved steering device for an outboard engine which has a reduced total length from the steering operation member to the helm mechanism and thus can be installed, or applied to, in many different types of bodies of boats.

It is another object of the present invention to provide an improved steering device for an outboard engine which can achieve an enhanced operability of the tiller handle.

According to a first aspect of the present invention, there is provided an improved steering device for an outboard engine, which comprises: a helm mechanism operable in response to operation of a steering operation member, provided on the body of a boat, to steer the outboard engine, the helm mechanism including a drive shaft disposed orthogonally to a steering output shaft of the steering operation member; and an electric assist mechanism for detecting steering torque, applied to the steering operation member, to assist operation of the steering operation member on the basis of the detected steering torque, the electric assist mechanism including an electric actuator that has an output shaft disposed orthogonally to the steering output shaft of the steering operation member.

Because the output shaft of the electric actuator of the electric assist mechanism and the drive shaft of the helm mechanism (steering mechanism) are disposed orthogonally to the steering output shaft of the steering operation member, the electric assist mechanism and helm mechanism can be disposed laterally relative to the steering output shaft, which can reduce the total length of the steering device from the steering operation member to the helm mechanism. As a result, the steering device of the present invention can be constructed in a compact size and thus can be installed in a variety of (i.e., many different types of) bodies of boats.

Preferably, the steering output shaft of the steering operation member and the drive shaft are interconnected through meshing engagement between a bevel gear mounted on the steering output shaft and a bevel gear mounted on the drive shaft. By changing a gear ratio between these bevel gears, it is possible to optimally adjust the steering angle of the steering operation member in accordance with operability required, for example, when the boat equipped with the steering device of the invention should leave a shore or should reach a shore.

Desirably, the helm mechanism comprises any one of a hydraulic helm pump (hydraulic steering pump) for steering the outboard engine by hydraulic pressure and a mechanical helm mechanism for mechanically steering the outboard engine. In this case, the present invention permits selective use or provision of any suitable one of the hydraulic helm pump and mechanical helm mechanism as the helm mechanism, depending on a type of the body of the boat. Thus, in assembling the steering device to the body of the boat, the present invention allows a suitable helm mechanism for the body of the boat to be selected from between the hydraulic helm pump and the mechanical helm mechanism, and can enhance a degree of design freedom of the steering device.

Preferably, the electric assist mechanism is controlled on the basis of the steering torque detected by the electric assist mechanism and the number of rotations of an engine for driving a propulsion propeller of the outboard engine. If the number of rotations of the engine increases to a considerable degree, the boat is brought into a high-speed gliding state (region) so that reactive force against the propulsion propeller increases. Thus, in the high-speed gliding region, the necessary steering force of the steering operation member increases. On the other hand, if the number of rotations of the engine decreases to a considerable degree, the boat is brought into a low-speed gliding state (region) so that the reactive force against the propulsion propeller decreases. Thus, in the low-speed gliding region, the necessary steering force of the steering operation member decreases. Therefore, in the present invention, the control section controls the electric assist mechanism on the basis of the number of rotations of the engine.

Thus, in high-speed gliding regions, the electric assist mechanism can be controlled to increase the steering force (assist force) to be applied to the steering operation member. In this way, the steering force to be applied to the steering operation member by a human operator can be reduced. In low-speed gliding regions, on the other hand, the electric assist mechanism can be controlled to decrease the steering force (assist force) to be applied to the steering operation member. In this way, the steering force to be applied to the steering operation member by the human operator can always be kept at suitable levels. Namely, stability of the steering, by the human operator, of the steering operation member can be enhanced by the steering force of the steering operation member being reduced in high-speed gliding regions and being kept at suitable levels in low-speed gliding regions.

According to a second aspect of the present invention, there is provided an improved steering device for an outboard engine which includes a tiller handle connected to an outboard engine body, steerably mounted to the body of a boat, for steering the outboard engine body via the tiller handle, which comprises: a torque sensor for detecting, as steering torque, a difference between respective steering angles of the outboard engine body and the tiller handle; an electric assist mechanism controllable on the basis of the steering torque detected via the torque sensor; and a helm mechanism drivable by the electric assist mechanism to operate so as to compensate for the difference between the respective steering angles of the outboard engine body and the tiller handle, the torque sensor being provided on a connection section connecting the outboard engine body and the tiller handle, the electric assist mechanism and the helm mechanism being provided on the body of the boat.

In the steering device of the present invention, the steering force (operating force) of the tiller handle can be assisted by the helm mechanism being driven by the electric assist mechanism to operate so as to compensate for the difference between the respective steering angles of the outboard engine body and the tiller handle. Thus, the necessary steering force of the tiller handle can be reduced, which can thereby enhance the operability of the tiller handle.

Further, the torque sensor is provided on the connection section connecting the outboard engine body and the tiller handle, and the electric assist mechanism and the helm mechanism are provided on the body of the boat. Because the torque sensor is a relatively compact (i.e., small-size) member, it can be provided on the connection section separately and at a considerable distance from the electric assist mechanism and helm mechanism. Thus, the torque sensor can be mounted, by using an existing connection section and, as necessary, making simple modification to the existing connection section.

Further, the electric assist mechanism and helm mechanism, from which the torque sensor is separated at a considerable distance, are provided on the body of the boat, and thus, a relatively great space can be readily secured on and in the body of the boat. As a result, there can be provided a body of a boat capable of appropriately mounting thereon the electric assist mechanism and helm mechanism, by merely making simple modification to an existing boat body, which can thereby expand the application of the steering device of the present invention.

In the steering device according to the second aspect of the present invention too, the helm mechanism may comprise any one of a hydraulic helm pump for steering the outboard engine by hydraulic pressure and a mechanical helm mechanism for mechanically steering the outboard engine. Thus, the present invention permits selective use or provision of any suitable one of the hydraulic helm pump and mechanical helm mechanism as the helm mechanism, depending on a type of the body of the boat. Further, the electric assist mechanism may be controlled on the basis of the steering torque detected by the torque sensor and the number of rotations of an engine for driving a propulsion propeller of the outboard engine. In this way, the steering device according to the second aspect of the present invention can achieve the same advantageous benefits as set forth above in relation to the steering device according to the first aspect of the present invention.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which:

FIGS. 15A and 15B are views explanatory of an example manner in which the body of the outboard engine is steered via the tiller handle;

DETAILED DESCRIPTION OF THE PREFERRED EMBODIMENTS

In the following description, the terms "front", "rear", "left" and "right" are used to refer to directions as viewed from a human operator aboard a boat.

Figure 1:
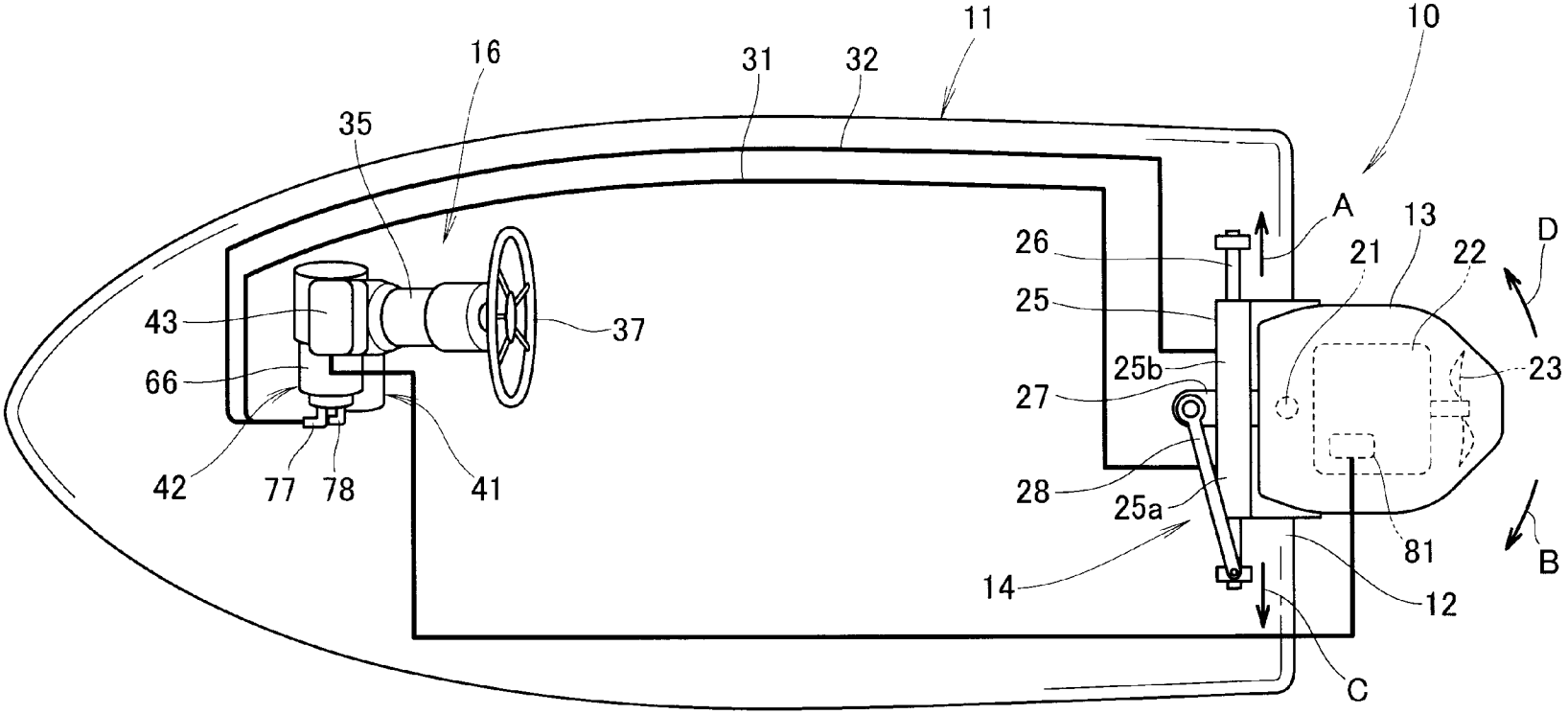
FIG. 1 is a plan view of the body of a boat provided with a first embodiment of a steering device for an outboard engine.

FIG. 1 is a plan view of the boat provided with a steering device 16 for an outboard engine according to a first embodiment of the present invention. As shown, the outboard engine 10 includes: an outboard engine body 13 mounted to a stern 12 of the body 11 of the boat; a cylinder unit 14 for steering the outboard engine body 13; and the steering device 16 for operating the cylinder unit 14.

The outboard engine body 13 mounted to the stern 12 of the body 11 of the boat is pivotable in a horizontal left-right direction via a swivel shaft 21. The outboard engine body 13 has an engine 22 provided therein, and a propulsion propeller 23 is connected to the output shaft of the engine 22.

The cylinder unit 14 includes a steering cylinder 25 provided on the stern 12 of the boat, and a rod 28 connecting an arm 27 to a steering piston 26 of the steering cylinder 25. The arm 27 is provided on the outboard engine body 13. The steering cylinder 25 has a left end portion 25*a* communicating with a left port portion 77 of a later-described hydraulic helm pump 66 via a left steering pipe 31, and has a right end portion 25*b* communicating with a right port portion 78 of the hydraulic helm pump 66 via a right steering pipe 32.

As hydraulic pressure acts on the left steering pipe 31 from the hydraulic helm pump 66, the steering piston 26 moves rightward as indicated by arrow A and thus the outboard engine body 13 pivots leftward (clockwise in FIG. 1) about the swivel shaft 21 as indicated by arrow B. As hydraulic pressure acts on the right steering pipe 32 from the hydraulic helm pump 66, on the other hand, the steering piston 26 moves leftward as indicated by arrow C and thus the outboard engine body 13 pivots rightward (counterclockwise in FIG. 1) about the swivel shaft 21 as indicated by arrow D.

Figure 2:
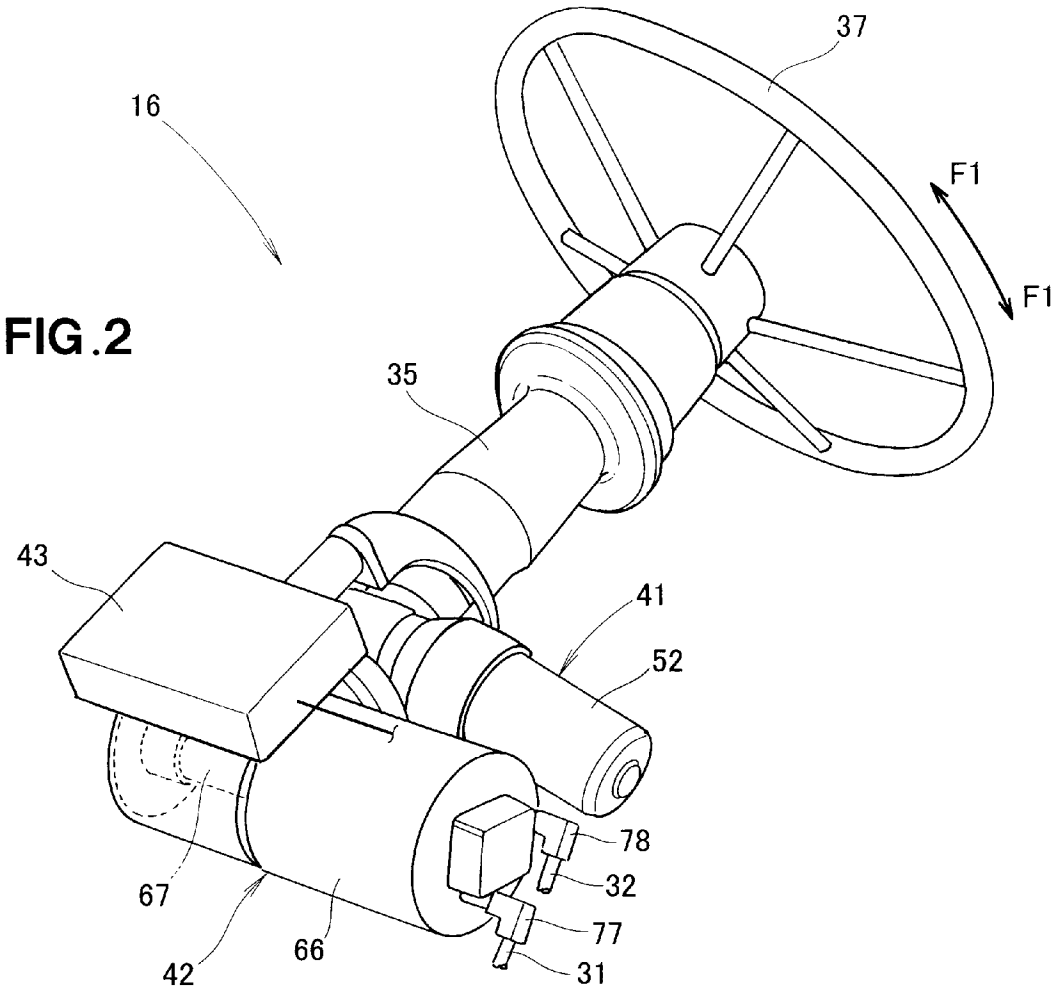
FIG. 2 is a perspective view of the steering device shown in FIG. 1.
Figure 3:
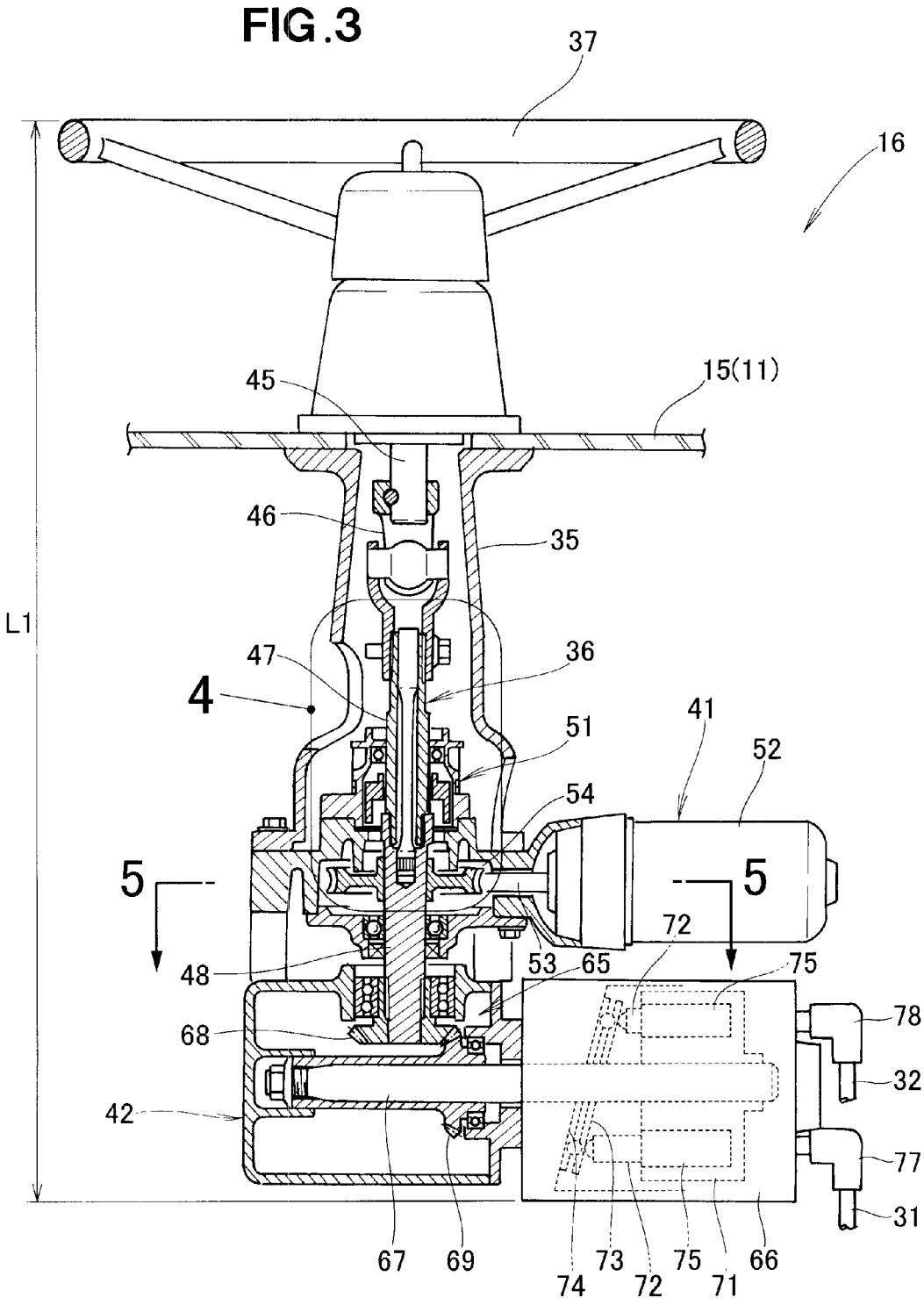
FIG. 3 is a sectional view of the steering device shown in FIG. 2.

As shown in FIGS. 2 and 3, the steering device 16 includes: a holder 35 fixed to an instrument panel 15 of the body 11 of the boat; a steering shaft unit 36 rotatably provided in the holder 35; a steering wheel 37 provided as a steering operation member on an upper end portion of the steering shaft unit 36; an electric assist mechanism 41 and helm mechanism 42 connected to a lower end portion of the steering shaft unit 36; and a control section 43 that controls the electric assist mechanism 41.

The steering device 16 has a function of actuating the helm mechanism 42 in response to operation of the steering wheel 37 provided on the body 11 of the boat so as to steer the outboard engine body 13 via the helm mechanism 42. The steering device 16 further has a function of enhancing the operability of the steering wheel 37 via the electric assist mechanism 41 when the human operator operates the steering wheel 37.

The steering shaft unit 36 includes: a steering shaft 45 connected to the steering wheel 37; a hollow steering input shaft 47 connected to the steering shaft 45 via a joint member 46; and a steering output shaft 48 provided under and coaxially with the steering input shaft 47. The steering output shaft 48 is rotatably supported in coaxial relation to the steering input shaft 47. The joint member 46 is a connecting member that couples the steering shaft 45 to the steering input shaft 47 in such a manner that the steering shaft 45 is tiltable in any desired directions relative to the steering input shaft 47.

The electric assist mechanism 41 includes: a torque sensor 51 for detecting steering torque transmitted to the steering input shaft 47; an electric actuator 52 actuatable or operable on the basis of the steering torque detected by the torque sensor 51; and an assist gear mechanism 54 that connects an output shaft 53 of the electric actuator 52 to the steering output shaft 48.

Figure 4:
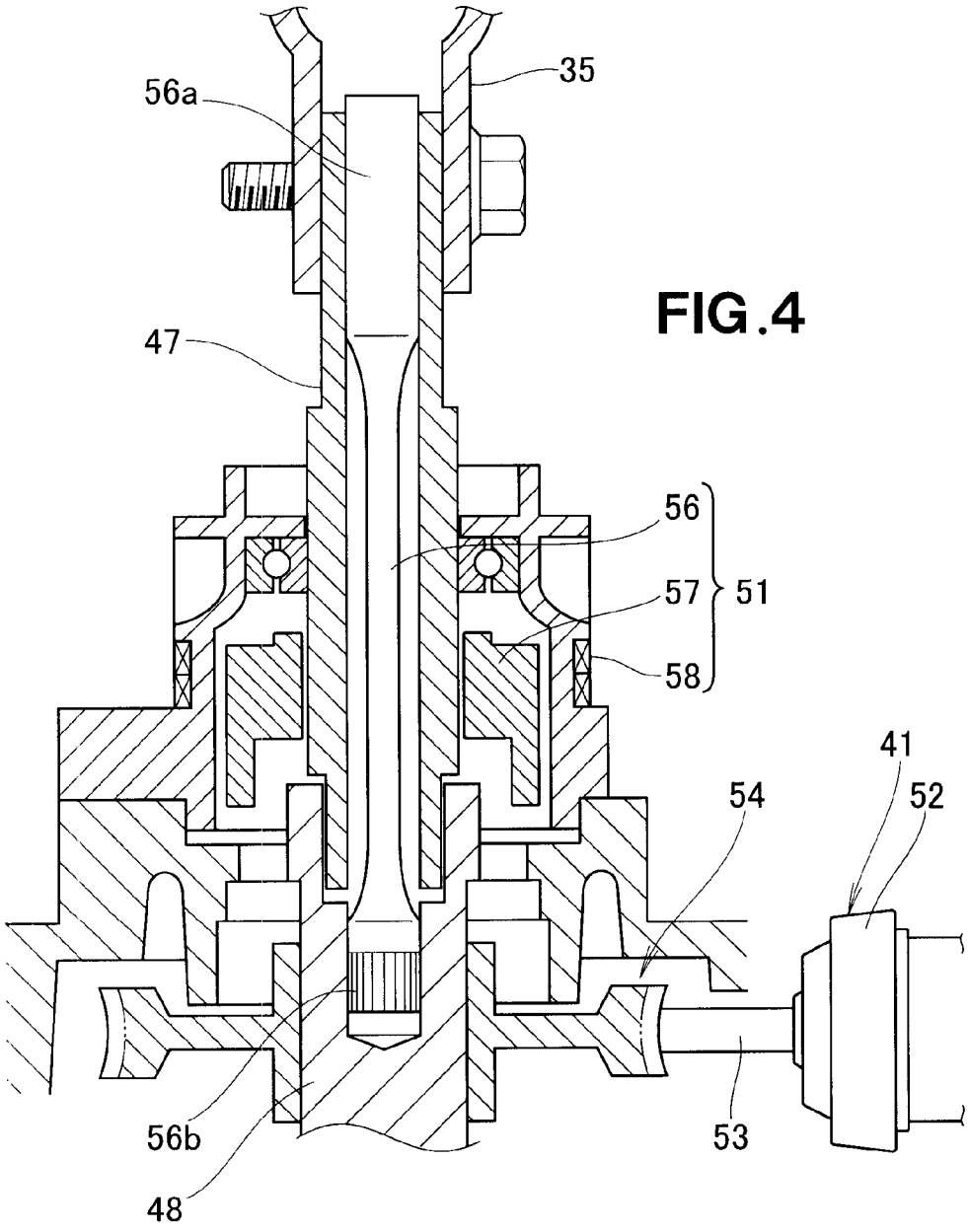
FIG. 4 is an enlarged view of a section surrounded by line L4 of FIG. 3.

As shown in FIG. 4, the torque sensor 51 is a conventional-type torque sensor which includes: a torsion bar 56 having an upper end portion 56*a* connected to the steering input shaft 47 and a lower end portion 56*b* connected to the steering output shaft 48; a torque ring 57 supported for movement in an axial direction of the torsion bar 56 (more specifically the steering input shaft 47); and a coil 58 provided around and radially outwardly of the torque ring 57.

The torque sensor 51 is constructed in such a manner that, when steering torque has been transmitted to the steering input shaft 47, torsion occurs in the torsion bar 56, the torque ring 57 moves in the axial direction of the steering input shaft 47 on the basis of the torsion of the torsion bar 56, an amount of the axial movement of the torque ring 57 is detected via the coil 58, and then the steering torque is detected on the basis of the detected amount of the axial movement.

The steering torque detected in the aforementioned manner is supplied to the control section 43 (FIG. 2). On the basis of the supplied detected steering torque, the control section 43 outputs a drive signal to the electric actuator 52. The electric actuator 52 is a conventional-type electric motor driven on the basis of the drive signal from the control section 43; more specifically, the output shaft 53 is rotated by the electric actuator 52 on the basis of the drive signal. A pinion 61 (FIG. 5) of the assist gear mechanism 54 is provided on the output shaft 53.

Figure 5:
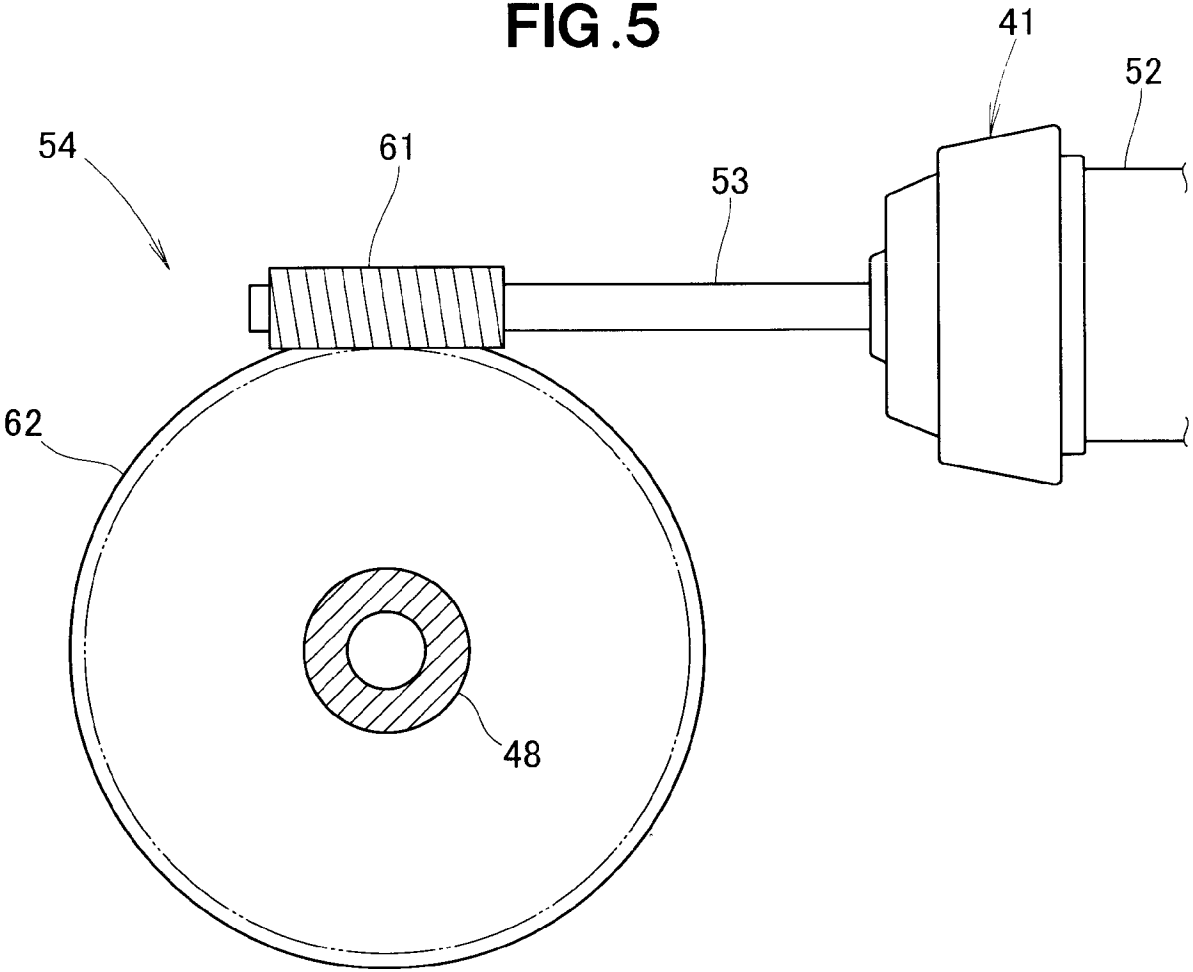
FIG. 5 is a sectional view taken along line 5-5 of FIG. 3.

As shown in FIGS. 3 and 5, the assist gear mechanism 54 includes the pinion 61 provided on the output shaft 53 of the electric actuator 52, and a helical gear 62 mounted on the steering output shaft 48 and meshing with the pinion 61.

The output shaft 53 of the electric actuator 52 is disposed orthogonally to the steering shaft unit 36 (more specifically, steering output shaft 48) connected to the steering wheel 37. The electric assist mechanism 41 is disposed between the steering wheel 37 and the helm mechanism 42. The reason why the output shaft 53 of the electric actuator 52 is disposed orthogonally to the steering shaft unit 36 (more specifically, steering output shaft 48) will be discussed later. With the pinion 61 meshing with the helical gear 62, the rotation of the pinion 61 can be transmitted to the steering output shaft 48 via the helical gear 62.

The pinion 61 rotates together with the output shaft 53 as the electric actuator 52 operates on the basis of the detected steering torque. Thus, the rotation of the steering output shaft 48 can be assisted by the electric actuator 52 (electric assist mechanism 41). In this way, the steering force (steering torque) of the steering wheel 37 can be assisted by the electric assist mechanism 41. Thus, the human operator can operate the steering wheel 37 with a relatively small steering force, which achieves an enhanced operability of the steering device.

In addition, the electric assist mechanism 41 has a function for assisting the steering force of the steering wheel 37 on the basis of the number of rotations of the engine 22 (hereinafter referred to as "number of engine rotations"). Namely, the electric assist mechanism 41 is constructed to be capable of appropriately controlling the operation of the steering wheel 37 on the basis of the detected steering torque and number of engine rotations.

As shown in FIGS. 2 and 3, the helm mechanism 42 includes a helm gear mechanism (steering gear mechanism) 65 that connects the steering output shaft 48 to a drive shaft 67 of the hydraulic helm pump (hydraulic steering pump) 66.

The hydraulic helm pump 66 operates in interlocked relation to the steering output shaft 48 via the helm gear mechanism 65.

The helm gear mechanism 65 includes a driving bevel gear 68 mounted on the steering output shaft 48, and a driven gear 69 mounted on the drive shaft 67 and meshing with the driving bevel gear 68. In other words, the steering output shaft 48 and the drive shaft 67 are interconnected through meshing engagement between the driving bevel gear 68 and the driven gear 69.

The drive shaft 67 of the helm mechanism 42 is disposed orthogonally to the steering shaft unit 36 (steering output shaft 48), and the helm mechanism 42 is disposed under the electric assist mechanism 41. Namely, the first embodiment of the steering device 16 has a total length L1 from the steering wheel 37 to the helm mechanism 42. The reason why the drive shaft 67 of the helm mechanism 42 is disposed orthogonally to the steering shaft unit 36 (steering output shaft 48) will be discussed later. In the hydraulic helm pump 66, a rotary member 71 rotates with the drive shaft 67 as the drive shaft 67 rotates, and pistons 72 rotate together with the rotary member 71 as the rotary member 71 rotates.

The pistons 72 move in their axial direction by rotating in sliding contact with a slanting plate 74 via a bearing 73, to thereby eject oil out of cylinders 75. Namely, the hydraulic helm pump 66 is a conventional-type piston pump (plunger pump).

Further, in the instant embodiment, the left steering pipe 31 is disposed in communication with the left port portion 77 of the hydraulic helm pump 66, while the right steering pipe 32 is disposed in communication with the right port portion 78 of the hydraulic helm pump 66.

With the oil ejected from the hydraulic helm pump 66, hydraulic pressure acts on any one of the left steering pipe and right steering pipe 32 of the steering cylinder 25 shown in FIG. 1, so that the steering piston 26 of the steering cylinder 25 moves leftward or rightward. Thus, the outboard engine body 13 pivots leftward or rightward about the swivel shaft 21, so that the body 11 of the boat can be steered leftward or rightward. In the aforementioned manner, the outboard engine body 13 can be steered by hydraulic pressure, using the hydraulic helm pump 66.

As noted above, the steering output shaft 48 and the drive shaft 67 are interconnected through meshing engagement between the driving bevel gear 68 and the driven gear 69. Thus, changing a gear ratio between the driving bevel gear 68 and the driven gear 69 allows a steering angle of the steering wheel 37 to be adjusted appropriately. In this way, the steering angle of the steering wheel 37 can be adjusted optimally in accordance with operability required, for example, when the boat should leave a shore or should reach a shore.

In addition, with the helm gear mechanism 65 comprising the driving bevel gear 68 and the driven gear 69, the rotation of the steering output shaft 48 can be transmitted to the drive shaft 67 of the helm mechanism 42 with a simplified construction. As a result, not only the total length L1 of the steering device 16 from the steering wheel 37 to the helm mechanism 42 can be reduced, but also the helm gear mechanism 65 can be simplified in construction and can be manufactured at reduced cost.

Further, as shown in FIGS. 1 and 2, the control section 43 has a function of supplying a drive signal to the electric assist mechanism 41 (electric actuator 52) on the basis of steering torque detected by the torque sensor 51. Thus, as the human operator operates the steering wheel 37, the steering force (steering torque) F1 of the steering wheel 37 can be assisted by the electric assist mechanism 41, as set forth above. As a result, the human operator can operate the steering wheel 37 with a relatively small steering force F1; namely, the steering device can be operated with an enhanced operability.

If the number of rotations of the engine 22 increases to a considerable degree, the boat is brought into a high-speed gliding state (region) so that reactive force against the propulsion propeller 23 increases. Thus, in the high-speed gliding region, the necessary steering force F1 of the steering wheel 37 increases. On the other hand, if the number of rotations of the engine 22 decreases to a considerable degree, the boat is brought into a low-speed gliding state (region) so that the reactive force against the propulsion propeller 23 decreases. Thus, in the low-speed gliding region, the necessary steering force F1 of the steering wheel 37 decreases.

Therefore, the control section 43 is equipped with the function of supplying a drive signal to the electric assist mechanism 41 (electric actuator 52) on the basis of the number of engine rotations. More specifically, the number of engine rotations is detected by a number-of-rotation detection section 81 (FIG. 1) and supplied to the control section 43.

If the detected number of engine rotations is relatively great, the control section 43 supplies the electric actuator 52 with a signal such that the steering assistance by the electric assist mechanism 41 can be promoted. Thus, in high-speed gliding regions, the electric assist mechanism 41 can be controlled by the control section 43 to increase the steering force (assist force) acting on the steering wheel 37. In this way, the steering force F1 to be applied to the steering wheel 37 by the human operator can be reduced.

On the other hand, if the detected number of engine rotations is relatively small, the control section 43 supplies the electric actuator 52 with a signal such that the steering assistance by the electric assist mechanism 41 can be suppressed. Thus, in low-speed gliding regions, the electric assist mechanism 41 can be controlled to decrease the steering force (assist force) acting on the steering wheel 37. In this way, the steering force F1 to be applied to the steering wheel 37 by the human operator can always be kept at suitable levels.

Namely, stability of the steering, by the human operator, of the steering wheel 37 can be enhanced by the steering force F1 to be applied to the steering wheel 37 being reduced in high-speed gliding regions and being kept at suitable levels in low-speed gliding regions.

As shown in FIG. 3, the output shaft of the electric actuator 52 is disposed orthogonally to the steering output shaft 48, and the drive shaft 67 of the helm mechanism 42 is disposed orthogonally to the steering output shaft 48. Thus, the electric assist mechanism 41 and the helm mechanism 42 can be disposed laterally relative to the steering output shaft 48, which can reduce the total length L1 from the steering wheel 37 to the helm mechanism 42. As a result, the steering device 16 can be constructed in a compact size and thus can be installed in a variety of bodies of boats.

Next, a description will be given about second and third embodiments of the present invention with reference to FIGS. 6 to 8, where similar elements to those in the first embodiment of the steering device 16 are indicated by the same reference numerals and characters as used for the first embodiment and will not be described here to avoid unnecessary duplication.

The following describe the second embodiment of the steering device 90. As seen from FIGS. 6 and 7, the second embodiment of the steering device 90 is different from the first embodiment of the steering device 16 in that it includes a mechanical helm mechanism (mechanical steering mechanism) 92 in place of the hydraulic helm pump 66 employed in the first embodiment, but similar to the first embodiment in other respects.

Figure 7:
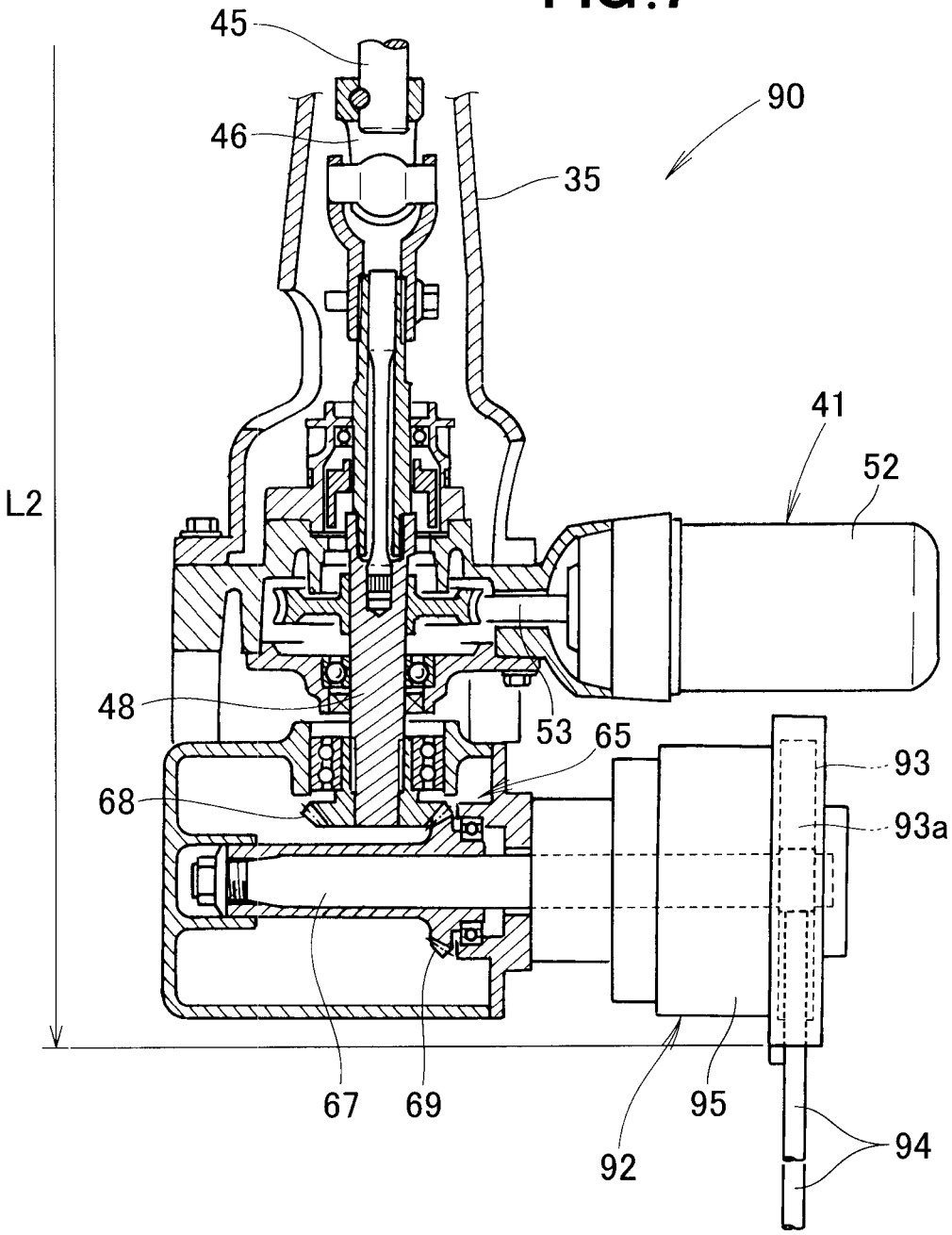
FIG. 7 is a sectional view of the steering device shown in FIG. 6.
Figure 8:
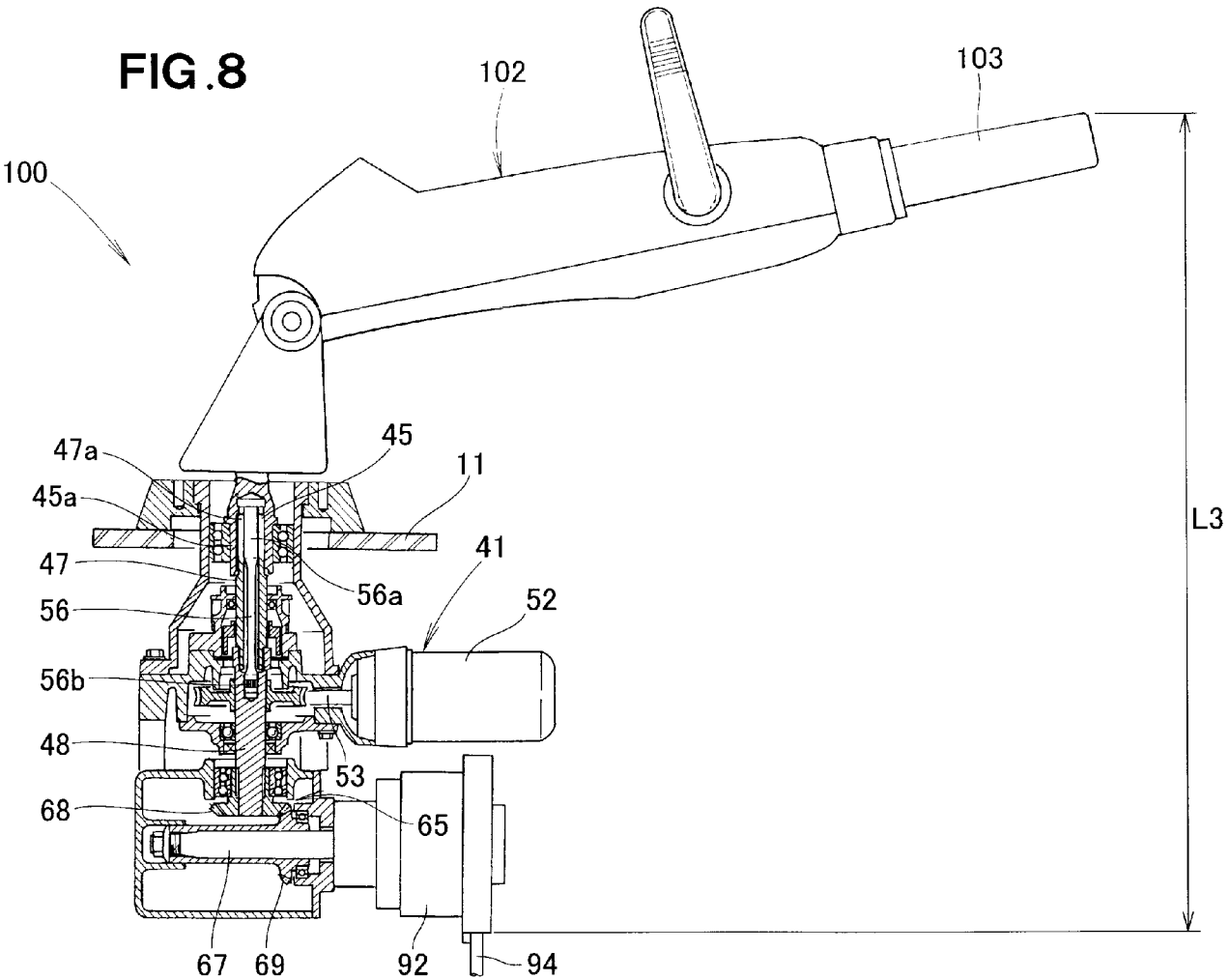
FIG. 8 is a sectional view of a third embodiment of the steering device of the present invention.

In the mechanical helm mechanism 92, a pulley 93 of FIG. 7 is mounted on the drive shaft 67 in coaxial relation thereto, and an operating cable 94 is wound on the outer periphery 93*a* of the pulley 93. More specifically, opposite portions of the operating cable 94 are taken out from a case 95 so that a pair of end portions 94*a* and 94*b* of the operating cable 94 extend to the outboard engine 13 (see also FIG. 1). One of the end portions 94*a* is connected to a right end portion 97*a* of a steering rod 97, while the other end portion 94*b* is connected to a left end portion 97*b* of the steering rod 97.

Figure 6:
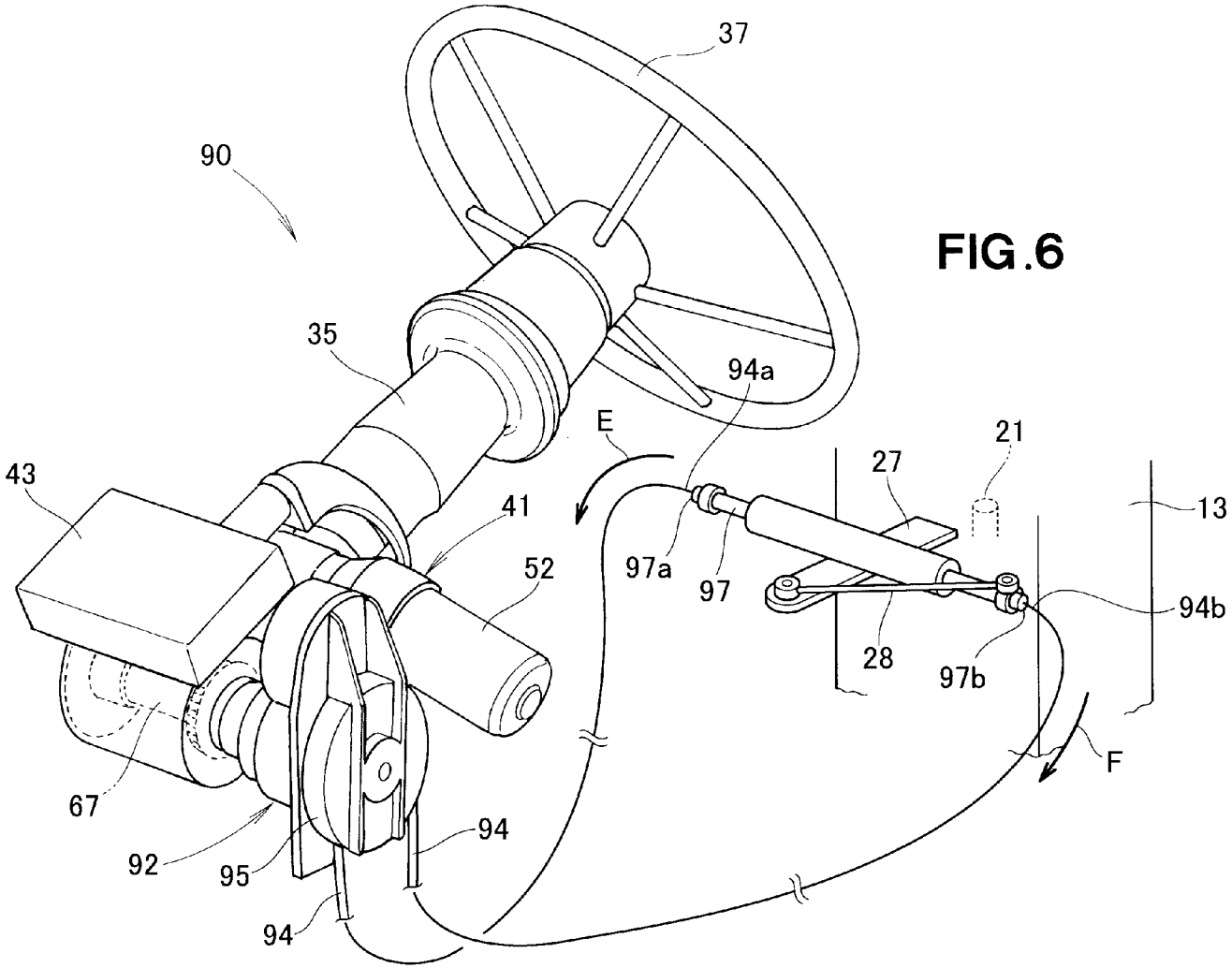
FIG. 6 is a perspective view of a second embodiment of the steering device of the present invention.

As the steering wheel 37 is steered leftward, the steering output shaft 48 rotates counterclockwise, so that the drive shaft 67 rotates clockwise in FIG. 6 via the helm gear mechanism 65. Thus, the pulley 93 rotates clockwise in FIG. 6 together with the drive shaft 67, so that the end portion 94*a* is pulled back toward the case 95 as indicated by arrow E in FIG. 6. As a consequence, the steering rod 97 moves rightward, so that the outboard engine body 13 pivots leftward about the swivel shaft 21.

On the other hand, as the steering wheel 37 is steered rightward, the steering output shaft 48 rotates clockwise, so that the drive shaft 67 rotates counterclockwise in FIG. 6 via the helm gear mechanism 65. Thus, the pulley 93 rotates counterclockwise in FIG. 6 together with the drive shaft 67, so that the end portion 94*b* is pulled back toward the case 95 as indicated by arrow F in FIG. 6. As a consequence, the steering rod 97 moves leftward, so that the outboard engine body 13 pivots rightward about the swivel shaft 21.

Namely, the mechanical helm mechanism 92 in the second embodiment is a mechanism for mechanically steering the outboard engine body 13. The drive shaft 67 of the mechanical helm mechanism 92 is disposed orthogonally to the steering shaft unit 36 (steering output shaft 48), similarly to the drive shaft 67 of the hydraulic helm pump 66 employed in the first embodiment.

Thus, the electric assist mechanism 41 and the mechanical helm mechanism 92 can be disposed laterally relative to the steering output shaft 48, which can achieve a reduced total length L2 from the steering wheel 37 to the mechanical helm mechanism 92. As a result, the steering device 90 can be constructed in a compact size and thus can be installed in a variety of bodies of boats.

In one preferred implementation of the embodiment, the helm mechanism to be provided in the steering device may be selected from between the aforementioned hydraulic helm pump 66 employed in the first embodiment and the aforementioned mechanical helm mechanism 92. Namely, when assembling the steering device to the body 11 of the boat, a suitable helm mechanism for the body 11 of the boat can be selected from between the hydraulic helm pump 66 and the mechanical helm mechanism 92. In this way, it is possible to enhance a degree of design freedom of the steering device.

The second embodiment of the steering device 90 constructed in the above-described manner can achieve the same advantageous benefits as the first embodiment of the steering device 16.

The following describe a third embodiment of the steering device 100 of the present invention, which is characterized in that a tiller handle 102 is provided as a steering operation member in place of the steering wheel 37; the other components of the third embodiment are similar to those of the second embodiment 90.

A lower end portion 45*a* of the steering shaft 45 and an upper end portion 47*a* of the steering input shaft 47 are disposed in coaxial communication with each other with the upper end portion 47*a* fitted in the lower end portion 45*a*. Thus, the joint member 46 employed in the first embodiment can be dispensed with, which can achieve an even further reduced total length L3 from the tiller handle 102 to the mechanical helm mechanism 92.

Further, as in the first embodiment, a torsion bar 56 has an upper end portion 56*a* connected to the upper end portion 47*a* of the steering input shaft 47 and a lower end portion 56*b* connected to the steering output shaft 48.

In the third embodiment of the steering device 100, as the human operator horizontally pivots the tiller handle 102 while holding a grip 103, the steering shaft 45 can pivot selectively clockwise or counterclockwise.

As noted above, the lower end portion 45*a* of the steering shaft 45 and the upper end portion 47*a* of the steering input shaft 47 are disposed in coaxial communication with each other. Thus, the outboard engine body 13 (FIG. 1) can be pivoted leftward or rightward about the swivel shaft 21 by operation of the mechanical helm mechanism 92.

In one preferred implementation of the embodiment, the steering operation member to be provided in the steering device may be selected from between the aforementioned steering wheel 37 of the first or second embodiment and the aforementioned tiller handle 102, in accordance with the type of the body 11 of the boat. Thus, the steering device of the present invention can be applied to a variety of bodies of boats, which can thereby expand the application of the steering device of the present invention.

Generally, a tiller handle is provided integrally with the body of an outboard engine, and thus, a mounting position of the tiller handle cannot be selected as desired. However, according to the third embodiment of the steering device 100, the tiller handle 102 can be provided separately and at a considerable distance from the outboard engine body 13. Thus, the tiller handle 102 can be mounted on any desired position of the body 11 of the boat, which can thereby enhance usability and design freedom of the steering device 100.

Furthermore, the third embodiment of the steering device 100 constructed in the above-described manner can achieve the same advantageous benefits as the second embodiment of the steering device 90.

The steering device of the present invention is not limited to the above-described embodiments 16, 90 and 100 and may be modified as appropriate as exemplified below.

For example, whereas the first embodiment has been described above in relation to the case where the helm mechanism 42 employs a piston pump (plunger pump) as the hydraulic helm pump 66, it is not so limited, and the helm mechanism 42 may employ, as the hydraulic helm pump 66, any other suitable type of pump, such as a cylinder-type hydraulic pressure generation device. The cylinder-type hydraulic pressure generation device may be constructed in such a manner that a pinion rotates together with the drive shaft 67 as the drive shaft 67 rotates, a rack moves in an axial direction of the cylinder in response to rotation of the pinion, a pair of pistons move in the axial direction of the cylinder in response to the movement of the rack, and oil is ejected from within the cylinder in response to the movement of the pair of pistons.

Figure 9:
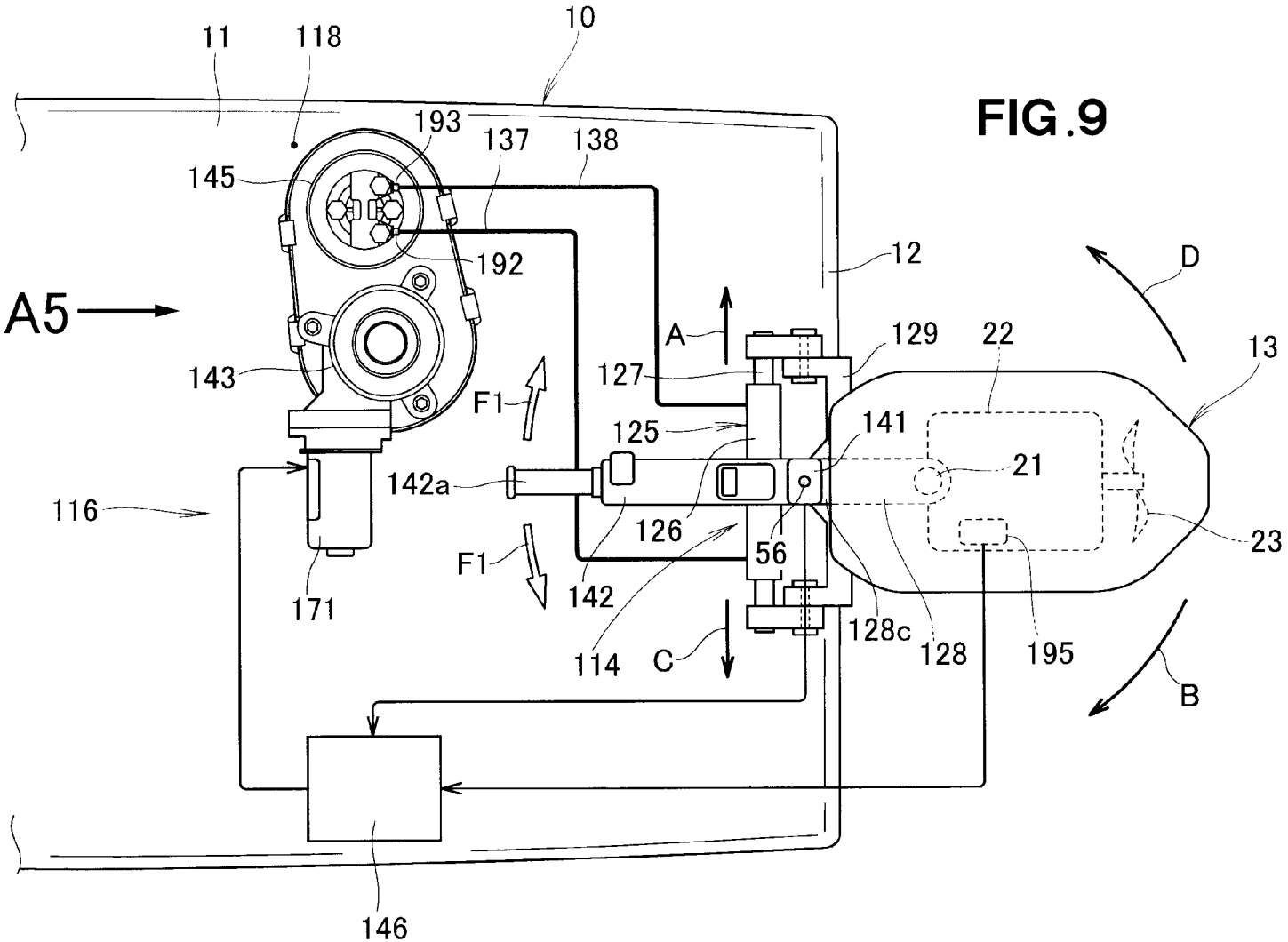
FIG. 9 is a plan view of a boat provided with a steering device for an outboard engine according to a fourth embodiment of the present invention.
Figure 10:
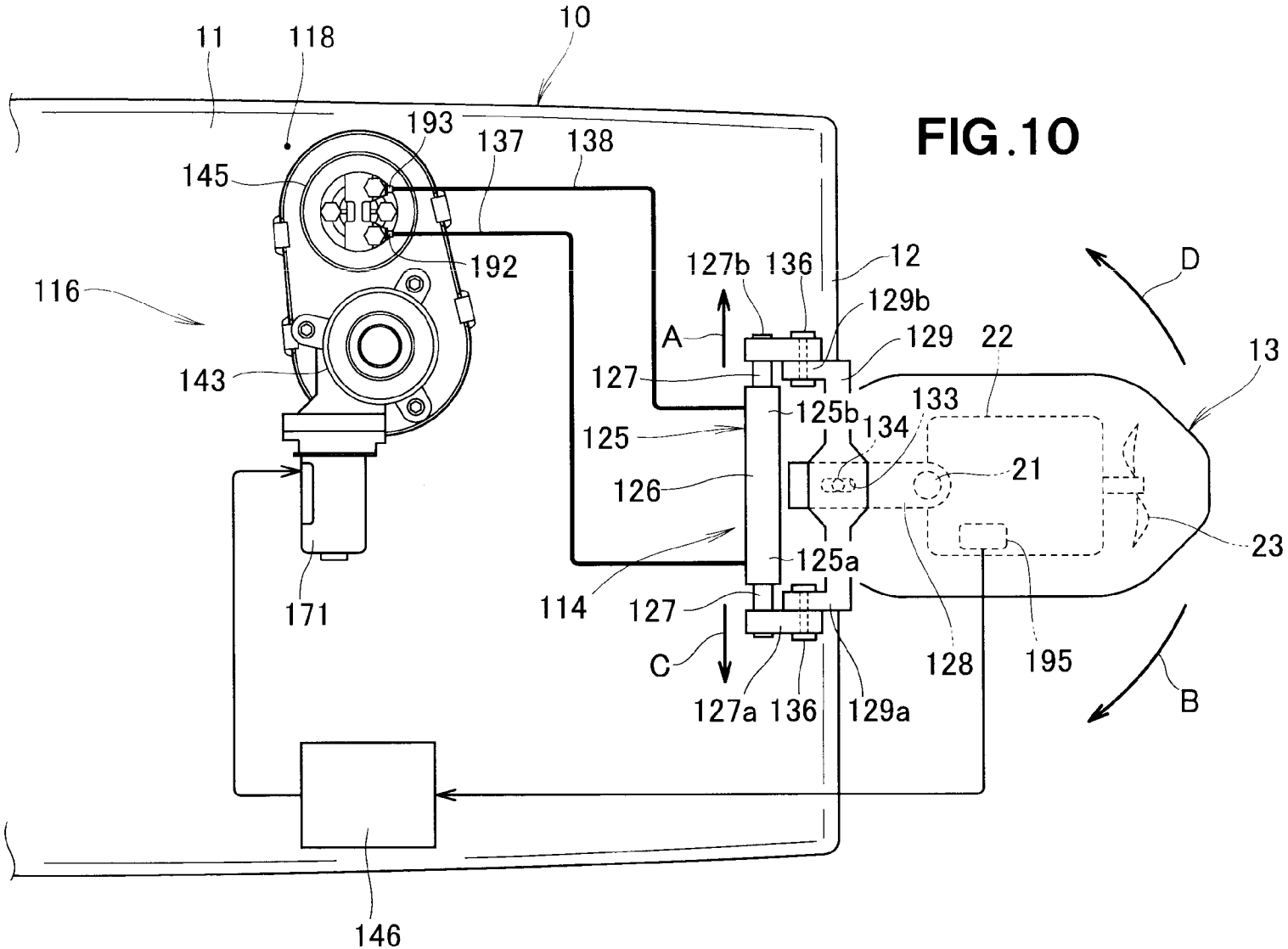
FIG. 10 is a plan view of the steering device of FIG. 9 with a tiller handle removed for clarity of illustration.

FIG. 9 is a plan view of a boat provided with a steering device 116 for an outboard engine according to a fourth embodiment of the present invention, and FIG. 10 is a plan view of the steering device 116 with a tiller handle removed for clarity of illustration. Similar elements to those in the first embodiment are indicated by the same reference numerals and characters as used for the first embodiment and will not be described here to avoid unnecessary duplication.

As shown in FIGS. 9 and 10, the outboard engine 10 includes: the outboard engine body 13 mounted to the stern 12 of the body 11 of the boat via a support base 117 (FIG. 11) that is fixed to the stern 12; a cylinder unit 114 for steering the outboard engine body 13; and the steering device 116 for operating the cylinder unit 114. The outboard engine body 13 is supported on the support base 117 in such a manner that it is pivotable in a horizontal left-right direction via the swivel shaft 21 and connection arm (connection section) 128. The support base 117 is fixed to the boat body 11. The outboard engine body 13 has an engine 22 provided therein, and a propulsion propeller 23 is connected to the output shaft of the engine 22.

Figure 11:
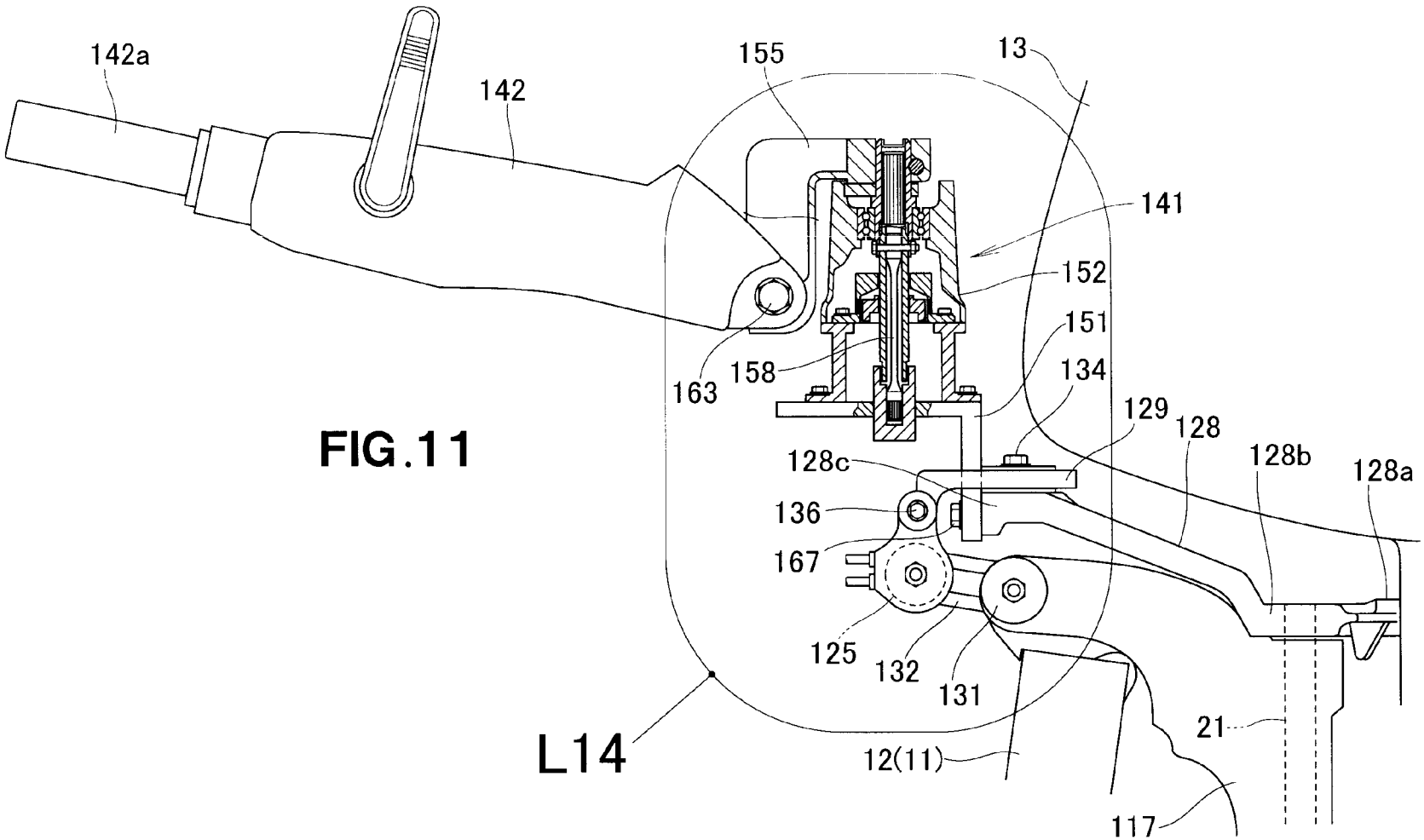
FIG. 11 is a side view showing the tiller handle employed in the fourth embodiment of the present invention.

The cylinder unit 114 includes a steering cylinder 125 provided on the stern 12 of the boat, and a connection bar 129 connecting the connection arm (connection section) 128 to a piston 127 of the steering cylinder 125. As shown in FIG. 11, the connection arm (connection section) 128 has a proximal end portion 128*a* connected to the outboard engine body 13, and a near-proximal-end portion 128*b* supported by the swivel shaft 21, and a distal end portion 128*c* projecting toward the front of the body 11 of the boat. The swivel shaft 21 is pivotably supported by the support base 117. The connection arm 128 may be an existing connection arm employed in many ordinary outboard engines.

The connection arm 128 is supported at its near-proximal-end portion 128*b* supported by the swivel shaft 21 in such a manner that the connection arm 128 is horizontally pivotable about the swivel shaft 21. The outboard engine body 13 is connected to the proximal end portion 128*a* of the connection arm 128 and thus is horizontally pivotable leftward or rightward about the swivel shaft 21.

With a cylinder section 126 supported by a pivot shaft 131 via a support member 132 The steering cylinder 125 in such a manner that it is disposed substantially horizontally along the width of the boat (see FIGS. 9 and 10). The swivel shaft 21 is a shaft that steerably supports the outboard engine body 13, and the pivot shaft 131 is a shaft that tiltably supports the outboard engine body 13.

Referring back to FIGS. 9 and 10, the steering cylinder 125 has a left end portion 125*a* communicating with a left port portion 192 of a later-described hydraulic helm pump (helm mechanism) 145 via a left steering pipe 137, and has a right end portion 125*b* communicating with a right port portion 193 of the hydraulic helm pump 145 via a right steering pipe 138.

The connection bar 129 is disposed in substantially parallel to the steering cylinder 125 behind the cylinder section 126. The connection bar 129 has a left end portion 129*a* connected to a left end portion 127*a* of the piston 127 via a bolt 136, and a right end portion 129*b* connected to a right end portion 127*b* of the piston 127 via a bolt 136.

Further, the connection bar 129 has an elongated hole portion 133 formed generally centrally therein, and this elongated hole portion 133 is fitted over a support shaft portion (support bolt) 134 (FIGS. 11 and 12), connected to the connection bar 128, in such a manner that it is pivotable about the support shaft portion 134 and slidable in its longitudinal direction relative to the support shaft portion 134.

As hydraulic pressure acts on the left steering pipe 137 from the hydraulic helm pump 145, the steering piston 127 moves rightward as indicated by arrow A in FIGS. 9 and 10, and thus, the connection bar 129 (and hence the elongated hole portion 133) moves rightward. Consequently, the support shaft portion 134 moves rightward, so that the outboard engine body 13 pivots leftward (clockwise in FIGS. 9 and 10) about the swivel shaft 21 as indicated by arrow B in FIGS. 9 and 10.

As hydraulic pressure acts on the right steering pipe 138 from the hydraulic helm pump 145, on the other hand, the steering piston 127 moves leftward as indicated by arrow C in FIGS. 9 and 10, and thus, the connection bar 129 (and hence the elongated hole portion 133) moves leftward. Consequently, the support shaft portion 134 moves leftward, so that the outboard engine body 13 pivots rightward (counterclockwise in FIGS. 9 and 10) about the swivel shaft 21 as indicated by arrow D in FIGS. 9 and 10.

The fourth embodiment of the steering device 116: includes a torque sensor 141 provided on a distal end portion 128*c* of the connection arm 128; the tiller handle 142 connected to the torque sensor 141; an electric assist mechanism 143 controllable on the basis of a signal sent from the torque sensor 141; the helm mechanism (steering mechanism) 145 connected to the electric assist mechanism 143 via a power transmission mechanism 144 (FIG. 13); and a control section 146 that controls the electric assist mechanism 143.

The fourth embodiment of the steering device 116 has a function of actuating the helm mechanism 145 in response to operation of the tiller handle 142 so as to steer the outboard engine body 13 via the helm mechanism 145. The steering device 116 further has a function of enhancing the operability of the tiller handle 142 via the electric assist mechanism 143 when the human operator operates the tiller handle 142.

In the steering device 116, the torque sensor 141 is provided on the distal end portion 128*c* of the connection arm 128 separately and at a considerable distance from the electric assist mechanism 143 and helm mechanism 145, and the electric assist mechanism 143 and helm mechanism 145, from which the torque sensor 141 is separated, are provided on the body 11 of the boat.

Figure 12:
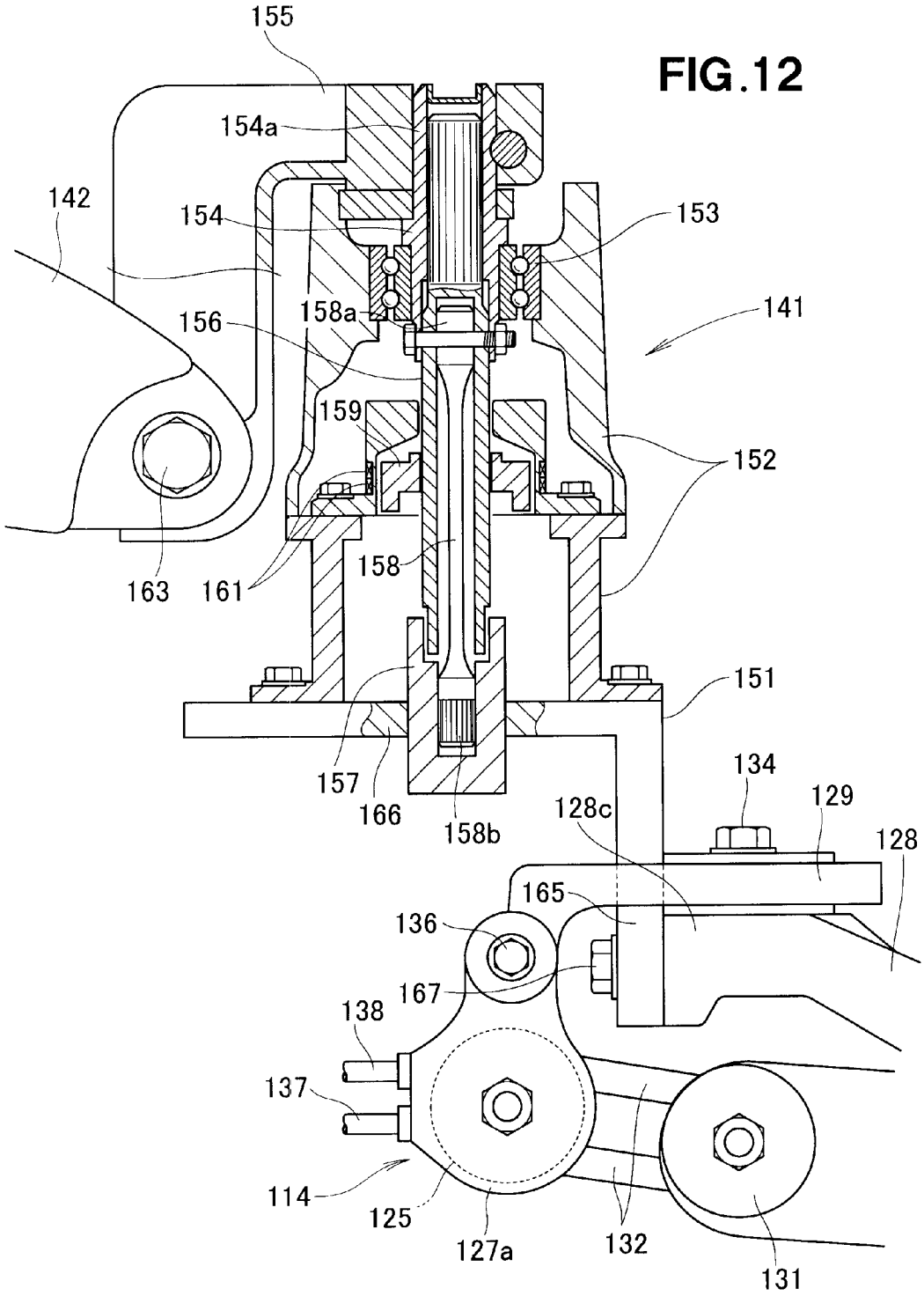
FIG. 12 is an enlarged view of a section surrounded by line L14 of FIG. 11.

As shown in FIGS. 11 and 12, the torque sensor 141, which is a conventional-type torque sensor, includes a base 151 fixed to the distal end portion 128*c* of the connection arm 128, holders 152 fixedly mounted on the base 151, a hollow support shaft 154 rotatably supported by the holders 152 via a bearing 153, and a swing arm 155 mounted on an upper end portion 154*a* of the hollow support shaft 154. The tiller handle 142 is connected to the swing arm 155 by means of a support bolt 163.

The base 151 is formed in a substantially L shape as viewed in side elevation and has a vertical portion 165 and a horizontal portion 166. The distal end portion 128*c* of the connection arm 128 is fixedly mounted to the vertical portion 165 of the base 151 by means of a plurality of mounting bolts 167, and the holders 152 are fixedly mounted to the horizontal portion 166 of the base 151.

The torque sensor 141 further includes: a torque input shaft 156 spline-coupled to the hollow support shaft 154; a torque output shaft 157 provided under the torque input shaft 156 in coaxial relation thereto and fixed to the horizontal portion 166 of the base 151; a torsion bar 158 having an upper end portion 158*a* connected to the torque input shaft 156 and a lower end portion 158*b* connected to the torque output shaft 157; a torque ring 159 provided around the outer surface of the torsion bar 158 (more specifically, torque input shaft 156) in such a manner that it is axially movable relative to the torsion bar 158 (torque input shaft 156); and coils 161 provided around the outer surface of the torque ring 159.

The swing arm 155 of the torque sensor 141 is rotatably supported by the holders 152 via the torque input shaft 156, and the torque input shaft 156 is connected to the torque output shaft 157 via the torsion bar 158. Thus, when torsion has occurred in the torsion bar 158, the swing arm 155 pivots via the torque input shaft 156. While no torque is occurring in the torsion bar 158, on the other hand, the swing arm 155 is supported integrally with the holders 152.

The torque sensor 141 constructed in the aforementioned manner detects, as steering torque, a difference in steering angle between the outboard engine body 13 and the tiller handle 142. In other words, when there has occurred a difference in steering torque between the outboard engine body 13 and the tiller handle 142, the torque sensor 141 detects the difference as steering torque.

More specifically, if a load acting on the outboard engine body 13 when the human operator has steered the outboard engine body 13 via the tiller handle 142 is relatively great, torsion occurs in the torsion bar 158. Thus, the swing arm 155 pivots about the torque input shaft 156 together with the tiller handle 142, and the torque input shaft 156 pivots together with the swing arm 155.

By the swing arm 155 pivoting about the torque input shaft 156 as above, a difference occurs in steering angle (steering torque) between the outboard engine body 13 and the tiller handle 142. Thus, the steering of the outboard engine body 13 can be kept in a state assisted by the electric assist mechanism 143 and helm mechanism 145.

If a load acting on the outboard engine body 13 when the human operator has steered the outboard engine body 13 via the tiller handle 142 is relatively small, on the other hand, no torsion occurs in the torsion bar 158. Thus, the tiller handle 142 and swing arm 155 pivots about the swivel shaft 21 together with the holders 152, base 151 and connection arm 128, so that there occurs no difference in steering angle (steering torque) between the outboard engine body 13 and the tiller handle 142. Thus, the steering of the outboard engine body 13 can be kept in a state not assisted by the electric assist mechanism 143 and helm mechanism 145.

The following describe how the steering device 116 behaves when there has occurred torsion in the torsion bar 158 of the torque sensor 141.

As torsion occurs in the torsion bar 158, the torque ring 159 moves along the axis of the torque input shaft 156. An amount of such axial movement of the torque ring 159 is detected via the coils 161, and the steering torque is detected by the torque sensor 141 on the basis of the thus-detected amount of the axial movement. Namely, with the torque sensor 141 constructed in the aforementioned manner, a difference in steering angle between the outboard engine body 13 and the tiller handle 142 can be detected as steering torque.

Figure 14:
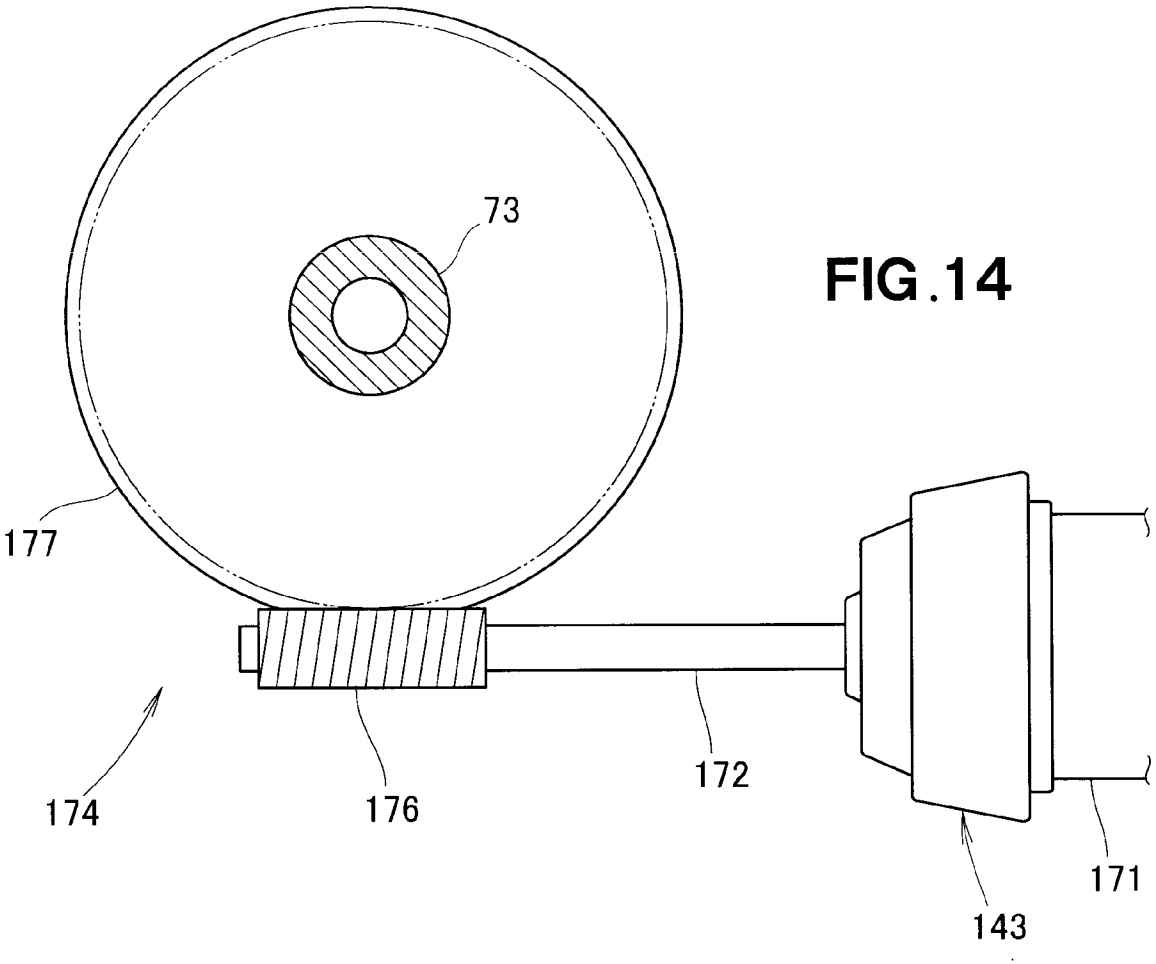
FIG. 14 is a sectional view taken along line 14-14 of FIG. 13.

The thus-detected steering torque is supplied to the control section 146 (see FIGS. 9 and 10). The control section 146 outputs a drive signal to the electric assist mechanism 143 (electric actuator 171) on the basis of the detected steering torque. The electric actuator 171 is a conventional-type electric motor that is driven to rotate the output shaft 172 (FIG. 14) on the basis of the drive signal from the control section 146. As seen in FIG. 14, a pinion 176 of an assist gear mechanism 174 is mounted on the output shaft 172 of the electric actuator 171.

As stated above, the torque sensor 141 is provided on the distal end portion 128*c* of the connection arm 128 separately and at a considerable distance from the electric assist mechanism 143 and helm mechanism 145. Because the torque sensor 141 is disposed at a considerable distance from the electric assist mechanism 143 and helm mechanism 145, it can be constructed in a compact shape. Thus, there can be provided the connection arm 128 capable of appropriately mounting thereon the compact torque sensor 141, by merely making simple modification to an existing connection arm.

Also, the electric assist mechanism 143 and helm mechanism 145, from which the torque sensor 141 is separated at a considerable distance, are provided on the body 11 of the boat, and thus, the body 11 can have a relatively great space secured therein and thereon. As a result, there can be provided the body 11 of the boat capable of appropriately mounting thereon the electric assist mechanism 143 and helm mechanism 145. Because the electric assist mechanism 143 and helm mechanism 145 can be provided through simple modification to an existing connection arm and boat body, the application of the steering device 116 can be expanded.

Figure 13:
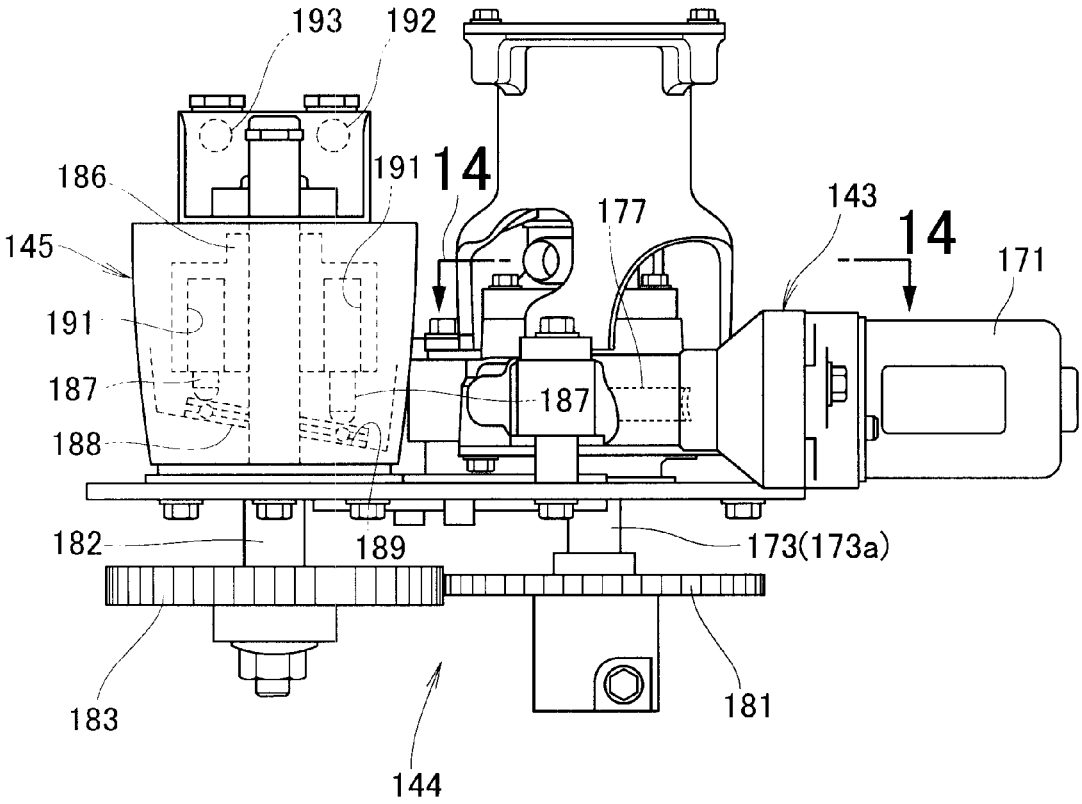
FIG. 13 is a view taken in a direction of arrow A5 of FIG. 9.

As shown in FIGS. 13 and 14, the electric assist mechanism 143 includes: the electric actuator 171 actuatable or operable on the basis of the steering torque detected by the torque sensor 141; and the assist gear mechanism 174 that connects the output shaft 172 of the electric actuator 171 to an assist output shaft 173. As shown in FIGS. 9 and 10, the electric assist mechanism 143 is provided on a right side region 118 of the boat body 11 together with the hydraulic helm pump 145.

The assist gear mechanism 174 includes the pinion 176 provided on the output shaft 172 of the electric actuator 171, and a helical gear 177 mounted on the assist output shaft 173 and meshing with the pinion 176. With the pinion 176 meshing with the helical gear 177 as above, the rotation of the pinion 176 can be transmitted to the assist output shaft 173 via the helical gear 177. The pinion 176 rotates together with the output shaft 172 as the electric actuator 171 operates on the basis of the detected steering torque.

In addition, the electric assist mechanism 143 has a function for assisting the steering force of the tiller handle 142 on the basis of the number of rotations of the engine 22 (hereinafter referred to as "number of engine rotations"). Namely, the electric assist mechanism 143 is constructed to be capable of appropriately controlling the operation of the tiller handle 142 on the basis of the detected steering torque and number of engine rotations.

The assist output shaft 173 projects downward below the helical gear 177 and is connected to the helm mechanism 145 via the power transmission means or section 144.

The power transmission section 144 includes a driving gear 181 mounted on a lower end portion 173*a* of the assist output shaft 173 in coaxial relation thereto, and a driven gear 183 mounted on a drive shaft 182 of the helm mechanism 145 in coaxial relation thereto and meshing with the driving gear 181.

Thus, the rotation of the assist output shaft 173 can be transmitted to the drive shaft 182 of the helm mechanism 145 via the driving gear 181 and driven gear 183.

The helm mechanism 145 is, for example, a hydraulic helm pump. As shown in FIGS. 9 and 10, the helm mechanism (hydraulic helm pump) 145 is provided on the right side region 118 of the boat body 11 together with the electric assist mechanism 143. The helm mechanism (hydraulic helm pump) 145 includes a rotary member 186 that rotates together with the drive shaft 182 as the drive shaft 182 rotates, and pistons 187 rotate together with the rotary member 186 as the rotary member 186 rotates.

The pistons 187 move in their axial direction by rotating in sliding contact with a slanting plate 189 via a bearing 188, to thereby eject oil out of cylinders 191. Namely, the hydraulic helm pump 145 is a conventional-type piston pump (plunger pump).

Further, in the instant embodiment, the left steering pipe 137 is disposed in communication with the left port portion 192 of the hydraulic helm pump 145, while the right steering pipe 138 is disposed in communication with the right port portion 193 of the hydraulic helm pump 145.

By the oil being ejected from the hydraulic helm pump 145, hydraulic pressure acts on any one of the left steering pipe 137 and right steering pipe 138 of the steering cylinder 125, so that the piston 127 of the steering cylinder 125 shown in FIG. 9 moves leftward or rightward. Thus, the outboard engine body 13 pivots leftward or rightward about the swivel shaft 21, so that the body 11 of the boat can be steered leftward or rightward. In the aforementioned manner, the outboard engine body 13 can be steered by hydraulic pressure, using the hydraulic helm pump 145.

As further shown in FIGS. 9 and 10, the control section 146 has the function of supplying a drive signal to the electric assist mechanism 143 (electric actuator 171) on the basis of steering torque detected by the torque sensor 141. Thus, as the human operator operates the tiller handle 142 while holding a grip 142*a*, there may occur a difference in steering angle between the outboard engine body 13 and the tiller handle 142. In such a case, torsion occurs in the torsion bar 158, and thus, steering torque can be detected on the basis of the torsion.

On the basis of the detected steering torque, the control section 146 outputs a drive signal to the electric assist mechanism 143 (electric actuator 171), so that the electric actuator 171 is driven on the basis of the drive signal from the control section 146.

Thus, as the human operator steers the outboard engine body 13 via the tiller handle 142, the steering force (steering torque) F1 of the tiller handle 142 can be assisted by the electric assist mechanism 143. In this way, the tiller handle 142 can be reduced in length, so that the operability of the tiller handle 142 can be enhanced.

If the number of rotations of the engine 22 increases to a considerable degree, the boat is brought into a high-speed gliding state (region) so that reactive force against the propulsion propeller 23 increases. Thus, in the high-speed gliding region, the necessary steering force F1 of the tiller handle 142 increases. On the other hand, if the number of rotations of the engine 22 decreases to a considerable degree, the boat is brought into a low-speed gliding state (region) so that the reactive force against the propulsion propeller 23 decreases. Thus, in the low-speed gliding region, the necessary steering force F1 of the tiller handle 142 decreases.

Therefore, the control section 146 is equipped with the function of supplying a drive signal to the electric assist mechanism 143 (electric actuator 171) on the basis of the number of engine rotations. More specifically, the number of engine rotations is detected by a number-of-rotation detection section 195 (FIG. 9) and supplied to the control section 146.

If the detected number of engine rotations is relatively great, the control section 146 supplies the electric actuator 171 with a signal such that the steering assistance by the electric assist mechanism 143 can be promoted. Thus, in high-speed gliding regions, the electric assist mechanism 143 can be controlled by the control section 146 to increase the steering force (assist force) to be applied to the tiller handle 142. In this way, the steering force F1 to be applied to the tiller handle 142 by the human operator can be reduced.

On the other hand, if the detected number of engine rotations is relatively small, the control section 146 supplies the electric actuator 171 with a signal such that the steering assistance by the electric assist mechanism 143 can be suppressed. Thus, in low-speed gliding regions, the electric assist mechanism 143 can be controlled to decrease the steering force (assist force) to be applied to the tiller handle 142. In this way, the steering force F1 to be applied to the tiller handle 142 by the human operator can always be kept at suitable levels.

Namely, stability of the steering, by the human operator, of the tiller handle 142 can be enhanced by the steering force F1 to be applied to the tiller handle 142 being reduced in high-speed gliding regions and being kept at suitable levels in low-speed gliding regions.

The following describe an example manner in which the outboard engine body 13 is steered via the tiller handle 142, with reference to FIGS. 15A and 15B.

For example, the human pivotally operates the tiller handle 142 rightward about the swivel shaft 21 as indicated by arrow EA in FIG. 15A, in response to which the outboard engine body 13 is steered leftward about the swivel shaft 21 as indicated by arrow FA in FIG. 15A.

At that time, if resistance of seawater etc. acting on the outboard engine body 13 is small, a relatively small load F2 acts on the outboard engine body 13. Thus, the tiller handle 142 and the outboard engine body 13 are steered together about the swivel shaft 21 without no difference between a steering angle θ 1 of the tiller handle 142 and a steering angle θ 2 of the outboard engine body 13. Stated differently, there occurs no difference in steering torque between the tiller handle 142 and the outboard engine body 13.

If resistance of seawater etc. acting on the outboard engine body 13 is great, on the other hand, a relatively great load F2 acts on the outboard engine body 13. Thus, the tiller handle 142 pivots about the torque input shaft 156 as indicated by arrow EA in FIG. 15A, so that there occurs a difference between the steering angle θ 1 of the tiller handle 142 and the steering angle θ 2 of the outboard engine body 13. Stated differently, there occurs a difference in steering torque between the tiller handle 142 and the outboard engine body 13. In this case, torsion occurs in the torsion bar 158, on the basis of which the torque sensor 141 detects steering torque.

The thus-detected steering torque is supplied to the control section 146, and the control section 146 outputs a drive signal to the electric assist mechanism 143 (electric actuator 171) on the basis of the detected steering torque. The electric assist mechanism 143 (electric actuator 171) is driven on the basis of the drive signal, so that the pinion 176 (see FIG. 14) rotates together with the output shaft 172 of the electric actuator 171, and such rotation of the pinion 176 is transmitted to the assist output shaft 173 (FIG. 15B) via the helical gear 177.

Consequently, as shown in FIG. 15B, rotation of the assist output shaft 173 is transmitted to the driving gear 181, and then rotation of the driving gear 181 is transmitted to the driven gear 183. Thence, rotation of the driven gear 183 is transmitted to the drive shaft 182 of the hydraulic helm pump 145. In this manner, the hydraulic helm pump 145 is driven, so that hydraulic pressure acts on the right steering pipe 138 of the steering cylinder 125.

Referring back to FIG. 15A, the piston 127 of the steering cylinder 125 moves rightward as indicated by arrow G, in response to which the outboard engine body 13 pivots leftward about the swivel shaft 21 as indicated by arrow FA. Thus, it is possible to eliminate the difference between the steering angle θ 1 of the tiller handle 142 and the steering angle θ 2 of the outboard engine body 13, i.e. the difference in steering torque between the tiller handle 142 and the outboard engine body 13. Namely, the steering angle θ 1 of the tiller handle 142 and the steering angle θ 2 of the outboard engine body 13 can be made to match each other.

Namely, when there has occurred a difference between the steering angle θ 1 of the tiller handle 142 and the steering angle θ 2 of the outboard engine body 13, the fourth embodiment of the steering device 116 can steer the outboard engine body 13 so as to follow the steering angle θ 1, by means of the electric assist mechanism 143 and hydraulic helm pump 145.

In this way, the steering device 116 can operate to compensate for the difference between the steering angle θ 1 of the tiller handle 142 and the steering angle θ 2 of the outboard engine body 13.

By operating to compensate for the difference between the steering angles θ 1 and θ 2 as above, the steering device 116 can assist the steering force (steering torque) of the tiller handle 142. Thus, the necessary steering force of the tiller handle 142 can be reduced, which can thereby enhance the operability of the tiller handle 142.

Whereas the foregoing have described how the steering device 116 behaves when the tiller handle 142 has been operated rightward to steer the outboard engine body 13 leftward, the steering device 116 behaves similarly to the above when the tiller handle 142 has been operated leftward to steer the outboard engine body 13 rightward. Therefore, a description about how the steering device 116 behaves when the tiller handle 142 has been operated leftward to steer the outboard engine body 13 rightward will be omitted.

Now, a description will be given about a fifth embodiment of the steering device 200, with reference to FIGS. 16 and 17. Similar elements to those in the fourth embodiment are indicated by the same reference numerals and characters as used for the fourth embodiment and will not be described here to avoid unnecessary duplication.

The fifth embodiment of the steering device 200 is different from the fourth embodiment of the steering device 116 in that it includes a mechanical helm mechanism (mechanical steering mechanism) 202 in place of the hydraulic helm pump 145 employed in the fourth embodiment, but similar to the fourth embodiment in other respects.

In the mechanical helm mechanism 202, a pulley 203 is mounted on the drive shaft 182 in coaxial relation thereto, and an operating cable 204 is wound on the outer periphery 203*a* of the pulley 203. More specifically, opposite portions of the operating cable 204 are taken out from a case 205 so that a pair of end portions 204*a* and 204*b* of the operating cable 204 extend to the outboard engine 13 (see also FIG. 9). One of the end portions 204*a* is connected to a right end portion 207*a* of a steering rod 207, while the other end portion 204*b* is connected to a left end portion 207*b* of the steering rod 207. The steering rod 207 extends through a support cylinder 206 in such a manner that it is slidable in the width direction of the boat body.

Namely, the mechanical helm mechanism 202 in the fifth embodiment is a mechanism for mechanically steering the outboard engine body 13.

Figure 16:
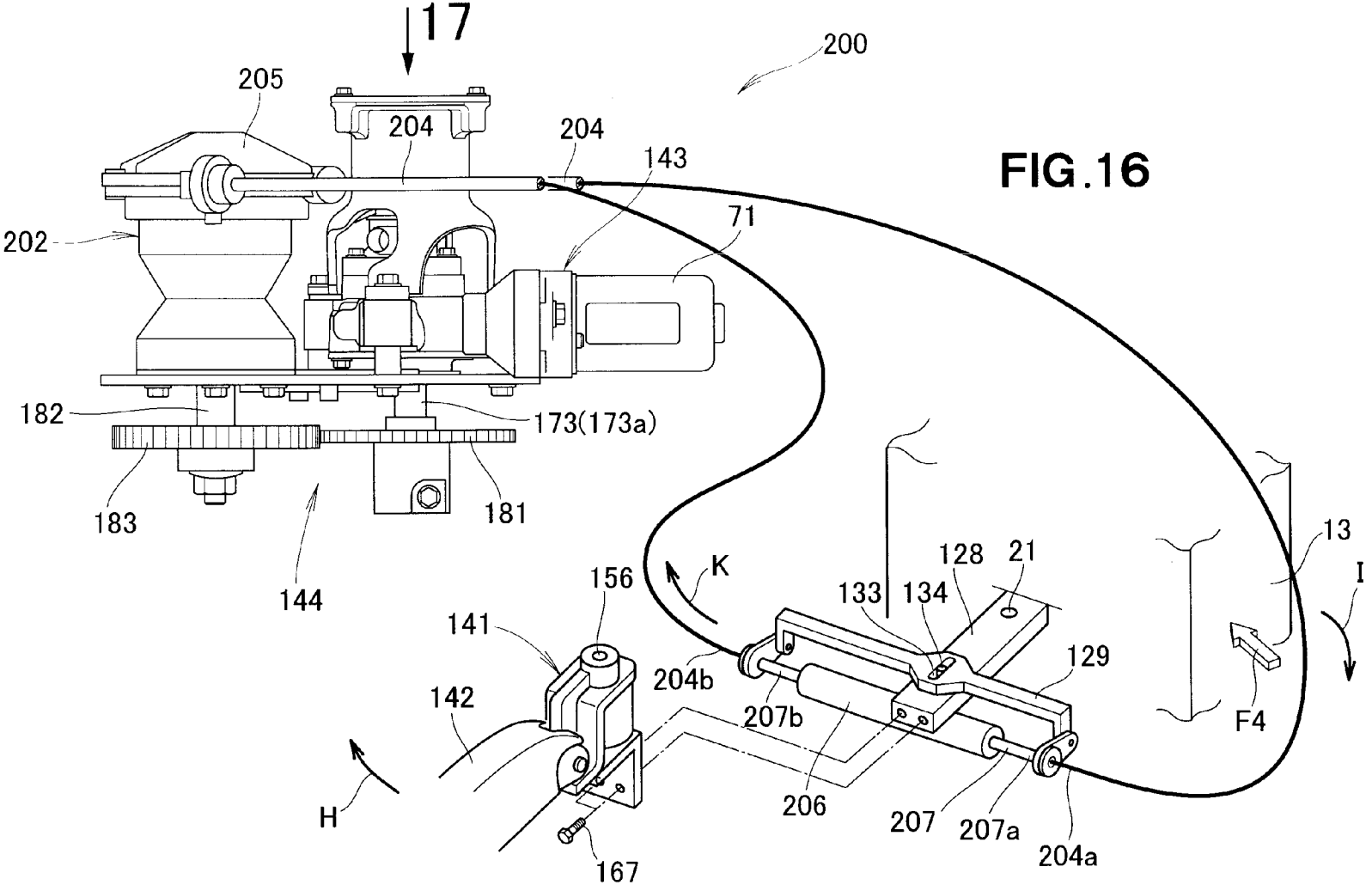
FIG. 16 is a view explanatory of a fifth embodiment of the steering device of the present invention.
Figure 17:
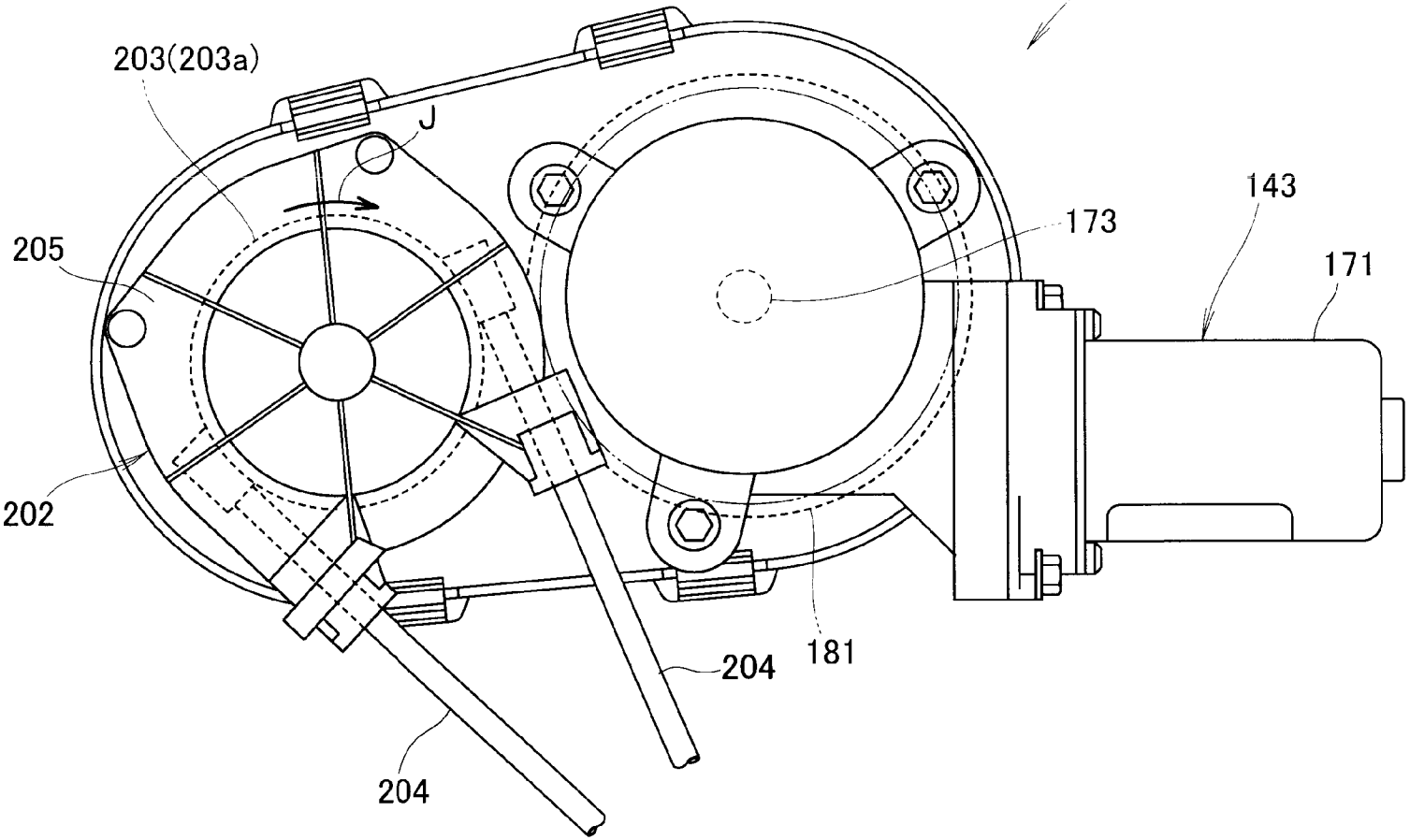
FIG. 17 is a view taken in a direction of arrow A9 of FIG. 16.

The following describe behavior of the fifth embodiment of the steering device 200, with reference to FIGS. 16 and 17. As shown in FIG. 16, as the tiller handle 142 is operated rightward as indicated by arrow H, the outboard engine body 13 is steered about the swivel shaft 21 as indicated by arrow I.

If resistance of seawater etc. acting on the outboard engine body 13 is small, a relatively small load F4 acts on the outboard engine body 13. Thus, the tiller handle 142 and the outboard engine body 13 are steered together about the swivel shaft 21, and, in this case, no difference occurs between the steering angle of the tiller handle 142 and the steering angle of the outboard engine body 13. Stated differently, there occurs no difference in steering torque between the tiller handle 142 and the outboard engine body 13.

If resistance of seawater etc. acting on the outboard engine body 13 is great, on the other hand, a relatively great load F4 acts on the outboard engine body 13. Thus, the tiller handle 142 pivots about the torque input shaft 156 as indicated by arrow H in FIG. 16, so that there occurs a difference 15 between the steering angle of the tiller handle 142 and the steering angle of the outboard engine body 13. Stated differently, there occurs a difference in steering torque between the tiller handle 142 and the outboard engine body 13. In this case, torsion occurs in the torsion bar 158 shown in FIG. 12, on the basis of which the torque sensor 141 detects steering torque.

The thus-detected steering torque is supplied to the control section 146, and the control section 146 outputs a drive signal to the electric assist mechanism 143 (electric actuator 171) on the basis of the detected steering torque. The electric actuator 171 is driven on the basis of the drive signal, so that the pinion 176 (see FIG. 14) rotates together with the output shaft 172 of the electric actuator 171, and such rotation of the pinion 176 is transmitted to the assist output shaft 173 via the helical gear 177.

Consequently, rotation of the assist output shaft 173 is transmitted to the driving gear 181, and then rotation of the driving gear 181 is transmitted to the driven gear 183. Then, rotation of the driven gear 183 is transmitted to the drive shaft 182 of the mechanical helm mechanism 202, so that the pulley 203 rotates clockwise as indicated by arrow J in FIG. 17 together with the drive shaft 182. By the pulley 203 rotating clockwise like this, the end portion 204*b* of the operating cable 204 is pulled back toward the case 205 as indicated by arrow K in FIG. 16. As a consequence, the steering rod 207 moves rightward, so that the outboard engine body 13 pivots leftward Thus, it is possible to eliminate the difference between the steering angle of the tiller handle 142 and the steering angle of the outboard engine body 13, i.e. the difference in steering torque between the tiller handle 142 and the outboard engine body 13. Namely, the steering angle of the tiller handle 142 and the steering angle of the outboard engine body 13 can be made to match each other.

Namely, when there has occurred a difference between the steering angle of the tiller handle 142 and the steering angle of the outboard engine body 13, the fifth embodiment of the steering device 200 can steer the outboard engine body 13 so as to follow the steering angle of the tiller handle 142, by means of the electric assist mechanism 143 and mechanical helm mechanism 202. In this way, the steering device 200 can operate to compensate for the difference between the steering angle of the tiller handle 142 and the steering angle of the outboard engine body 13.

By operating to compensate for the difference between the steering angles by means of the mechanical helm mechanism 202 as above, the steering device 200 can assist the steering force (steering torque) of the tiller handle 142, like the fourth embodiment. Thus, the necessary steering force of the tiller handle 142 can be reduced, which can thereby enhance the operability of the tiller handle 142.

Whereas the foregoing have described how the steering device 200 behaves when the tiller handle 142 has been operated rightward to steer the outboard engine body 13 leftward, the steering device 116 behaves similarly to the above when the tiller handle 142 has been operated leftward to steer the outboard engine body 13 rightward. Therefore, a description about how the steering device 200 behaves when the tiller handle 142 has been operated leftward to steer the outboard engine body 13 rightward will be omitted.

In one preferred implementation of the embodiment, the helm mechanism to be provided in the steering device may be selected from between the aforementioned hydraulic helm pump 145 employed in the fourth embodiment and the aforementioned mechanical helm mechanism 202 employed in the fifth embodiment. Namely, when assembling the steering device to the body of the boat, a suitable helm mechanism for the body of the boat can be selected from between the hydraulic helm pump 145 and the mechanical helm mechanism 202. In this way, it is possible to enhance a degree of design freedom of the steering device.

The fifth embodiment of the steering device 200 constructed in the above-described manner can achieve the same advantageous benefits as the fourth embodiment of the steering device 116.

The steering device of the present invention is not limited to the above-described embodiments 116 and 200 and may be modified as appropriate as exemplified below.

For example, whereas the fourth and fifth embodiments have been described above in relation to the case where the helm mechanism 145 employs a piston pump (plunger pump) as the hydraulic helm pump 145, it is not so limited, and the helm mechanism may employ, as the hydraulic helm pump 145, any other suitable type of pump, such as a cylinder-type hydraulic pressure generation device. The cylinder-type hydraulic pressure generation device may be constructed in such a manner that a pinion rotates together with the drive shaft 182 as the drive shaft 182 rotates, a rack moves in an axial direction of the cylinder in response to rotation of the pinion, a pair of pistons move in the axial direction of the cylinder in response to the movement of the rack, and oil is ejected from within the cylinder in response to the movement of the pair of pistons.

Further, whereas the fourth and fifth embodiments have been described above in relation to the case where the power transmission section 144 is constructed as a gear transmission section employing the driving and driven gears 181 and 183, the present invention is not so limited, and the power transmission section 144 may employ any other suitable type of transmission means, such as a chain or belt.

Furthermore, whereas the fourth and fifth embodiments have been described above in relation to the case where the connection arm (connection section) 128 is obtained by merely making modification to an existing connection arm, the present invention is not so limited, and such a connection arm (connection section) 128 may be newly formed for use in the fourth and fifth embodiments.

Furthermore, the fourth embodiment has been described above in relation to the case where the connection arm 128 is connected to the piston 127 of the cylinder unit 114 via the connection bar 129, and the fifth embodiment has been described above in relation to the case where the connection arm 128 is connected to the steering rod 207 via the connection bar 129. The connection bar 129 is not limited to the shape and construction shown and described above and may be modified as necessary.

Furthermore, the fourth embodiment has been described above in relation to the case where the electric assist mechanism 143 and the hydraulic helm pump 145 are provided together on the right side region 118 of the boat body 11, and the fifth embodiment has been described above in relation to the case where the electric assist mechanism 143 and the mechanical helm mechanism 202 are provided together on the right side region 118 of the boat body 11. However, these electric assist mechanism 143 and hydraulic helm pump 145 or mechanical helm mechanism 202 may be provided separately from each other on any desired portion of the boat body 11.

Finally, it should be appreciated that the shapes and constructions of the above-described steering devices 16, 90, 100, 116 and 200, outboard engine 10, body 11 of the boat, engine 22, propulsion propeller 23, steering wheel 37, electric assist mechanisms 41 and 143, helm mechanisms 42 and 145, control sections 43 and 146, steering shaft 45, steering output shaft 48, electric actuators 52 and 171, output shaft 53, drive shafts 67 and 182, driving and driven bevel gears 68 and 69, mechanical helm mechanisms 92 and 202, tiller handles 102 and 142, connection arm 128, torque sensors 51 and 141, etc. are not limited to those described above and may be modified as necessary.

The basic principles of the present invention are well suited for application to outboard engines equipped with a steering device which operates a helm mechanism in response to operation of a steering operation member, provided on the body of a boat, so as to steer the outboard engine.

What is claimed is:

1. A steering device for an outboard engine which includes a tiller handle connected to an outboard engine body, steerably mounted to a body of a boat, for steering the outboard engine body via the tiller handle, the steering device comprising:

a torque sensor for detecting, as steering torque, a difference between respective steering angles of the outboard engine body and the tiller handle;

an electric assist mechanism controllable on the basis of the steering torque detected via the torque sensor; and a helm mechanism drivable by the electric assist mechanism to operate so as to compensate for the difference between the respective steering angles of the outboard engine body and the tiller handle, the torque sensor being provided on a connection section connecting the outboard engine body and the tiller handle, the electric assist mechanism and the helm mechanism being provided on the body of the boat.

2. The steering device of claim 1, wherein the helm mechanism comprises any one of a hydraulic helm pump for steering the outboard engine by hydraulic pressure and a mechanical helm mechanism for mechanically steering the outboard engine.

3. The steering device of claim 1, wherein the electric assist mechanism is controlled on the basis of the steering torque detected by the torque sensor and a number of rotations of an engine for driving a propulsion propeller of the outboard engine.

* * * * *

UNITED STATES PATENT AND TRADEMARK OFFICE

CERTIFICATE OF CORRECTION

PATENT NO. : 8,393,925 B2
APPLICATION NO. : 12/947166
DATED : March 12, 2013
INVENTOR(S) : Yoshihiro Harada et al.

It is certified that error appears in the above-identified patent and that said Letters Patent is hereby corrected as shown below:

On the Title Page, under (*) Notice, delete "This patent is subject to a terminal disclaimer."

Signed and Sealed this
Thirteenth Day of August, 2013

Teresa Stanek Rea
*Acting Director of the United States Patent and Trademark Office*